US005496691A

United States Patent [19]

Miyamoto et al.

[11] Patent Number: 5,496,691

[45] Date of Patent: Mar. 5, 1996

[54] PROCESS FOR PRODUCING SILVER HALIDE PHOTOGRAPHIC MATERIAL

[75] Inventors: Hajime Miyamoto; Masahiko Murayama, both of Kanagawa, Japan

[73] Assignee: Fuji Photo Film Co., Ltd., Kanagawa, Japan

[21] Appl. No.: 383,931

[22] Filed: Feb. 6, 1995

[30] Foreign Application Priority Data

| | | | |
|---|---|---|---|
| Feb. 8, 1994 | [JP] | Japan | 6-014669 |
| Feb. 9, 1994 | [JP] | Japan | 6-015536 |
| Feb. 9, 1994 | [JP] | Japan | 6-035182 |

[51] Int. Cl.[6] ..... G03C 1/785

[52] U.S. Cl. ..... 430/539; 430/527; 430/532; 430/533; 430/537; 430/640; 430/642; 430/930

[58] Field of Search ..... 430/532, 533, 430/537, 539, 930, 527, 640, 642

[56] References Cited

U.S. PATENT DOCUMENTS

| | | | |
|---|---|---|---|
| 3,875,119 | 4/1975 | Aoki et al. | 528/298 |
| 4,141,735 | 2/1979 | Schrader et al. | 430/533 |
| 5,045,441 | 9/1991 | Takamuki et al. | 430/527 |
| 5,294,473 | 3/1994 | Kawamoto | 430/533 |
| 5,368,997 | 11/1994 | Kawamoto | 430/533 |
| 5,380,577 | 1/1995 | Hamano et al. | 428/143 |
| 5,395,742 | 3/1995 | Deguchi et al. | 430/429 |
| 5,409,806 | 4/1995 | Otani | 430/505 |
| 5,437,970 | 8/1995 | Shono | 430/522 |

*Primary Examiner*—Hoa Van Le

*Attorney, Agent, or Firm*—Sughrue, Mion, Zinn, Macpeak & Seas

[57] ABSTRACT

A process for producing a silver halide photographic material comprising a polyester support having thereon at least one light-sensitive layer and at least one undercoat layer is described, wherein the undercoat layer is provided by coating a solution containing gelatin for an undercoating binder having a calcium ion ($Ca^{++}$) content of from 10 to 2,500 ppm based on dry gelatin.

20 Claims, No Drawings

PROCESS FOR PRODUCING SILVER HALIDE PHOTOGRAPHIC MATERIAL

FIELD OF THE INVENTION

The present invention relates to a process for producing a silver halide photographic material using a polyester support insusceptible to a curling habit (i.e., a winding habit) in the rolled film state and having excellent coatability in undercoating and superior adhesion property.

BACKGROUND OF THE INVENTION

PET film has excellent productivity, mechanical strength and dimensional stability, however, a strong curling habit remains after development to give rise to poor handle-ability and therefore, the use thereof is restricted in spite of the above-described excellent properties. Namely, it has been difficult to use the PET film as a rolled film such as a color negative film.

Recently, the photographic material has been used in diversified fields and it is radically driven to achieve miniaturization of a camera, high-speed film conveyance in photographing and high magnification in taking a picture. In association therewith, the support is required to have strength, dimensional stability and thin film capability. Further, as the miniaturization of a camera proceeds, miniaturization of a patrone has been increasingly demanded. In order to realize the miniaturization of a patrone, two problems remain to be solved. One problem is the reduction in mechanical strength accompanying the thinning of film and another problem is an intensified curling habit generated after storage due to the miniaturized spool.

As a method for reducing the curling habit of polyester film, methods as described, for example, in JP-A-51-16358 (the term "JP-A" as used herein means an "unexamined published Japanese patent application"), JP-A-1-131550 and U.S. Pat. No. 4,141,735 are known. However, the silver halide photographic material is used in various environment, for example, it may be left in an automobile parked outdoors in midsummer, where the temperature temporarily rises up near 90° C., and accordingly, it has also been demanded to prevent intensification of the curling habit at such high temperatures.

The high magnification of a print can first be achieved when not only the light-sensitive layer is uniformly coated but also a uniform undercoat layer free from aggregate is realized.

Heretofore, the binder used for the undercoat layer has been mainly gelatin. However, when an organic solvent capable of drying the undercoat layer at a low temperature within a short period of time is used, the gelatin containing a large amount of metals or ions readily aggregates. The aggregate has been conventionally removed by filtering the undercoating solution through a filter after the preparation of the solution, however, if the filter size is made small, although the aggregate as a problem in printing may be removed, the frequency of filter exchange increases, which is disadvantageous in view of productivity.

Further, an attempt has been made to improve coat-ability of the undercoating solution by adding a surface active agent to the undercoating solution. However, the anionic surface active agent exhibits poor solubility in the coating solution containing an organic solvent to fail in imparting sufficient surface activation effect, whereas if a cationic surface active agent is used as a surface active agent for the undercoating solution, aggregation is generated at the interface of the undercoat layer on coating of an emulsion layer containing a large amount of anionic materials to deteriorate the surface property. Furthermore, when a solution having dispersed therein as an electrically conductive material fine particles of at least one crystalline metal oxide selected from the group consisting of ZnO, $TiO_2$, $SnO_2$, $Al_2O_3$, $In_2O_3$, $SiO_2$, MgO, BaO, $MoO_3$ and $V_2O_5$, which are used as an antistatic agent, or a composite oxide of these is coated on the undercoat layer, aggregation is generated at the interface of the undercoat layer because the electrically conductive material is negatively charged in the coating solution. Still further, with the use of a betaine surface active agent, aggregation is caused at the interface on coating an emulsion layer containing a large amount of anionic materials. Thus, the addition of a surface active agent is not preferred.

In order to bond a silver halide emulsion layer to a polyester support, an undercoat layer must be provided. For coating an undercoat layer of a polyethylene terephthalate support, methods described in JP-A-48-24723, JP-B-49-26580 (the term "JP-B" as used herein means an "examined Japanese patent publication"), JP-A-51-114120, JP-A-1-210947 and JP-A-3-109545 may be used. However, the polyester support of the present invention is difficult to adhere as compared with the polyethylene terephthalate film and conventional techniques fail in adhesion of the polyester support. Further, as the environment where the silver halide photographic material is used is diversified, the adhesion performance becomes worse in coating an emulsion layer on the polyester support according to conventional techniques and a further improved technique has been demanded. Furthermore, in the case where a polyester support is used, the polyester support is liable to have electric charge during conveyance at photographing or in an automatic developing machine and as a result, a discharge occurs to cause fogging. The current techniques for preventing electrification are insufficient because there arises a problem that since materials used are eluted out into the processing solution, the electrification preventing performance (i.e., the antistatic property) is lost after development, and dusts attached due to the electric charge are also printed.

JP-A-51-3619 describes the use of polyamide resin in the undercoat layer so as to bond a silver halide emulsion layer to the polyester support.

One of the surface treatment techniques for bonding a silver halide emulsion layer to the polyester support is glow discharge treatment. U.S. Pat. Nos. 3,462,335, 3,761,299 and 4,072,769 and British Patent 891,469 describes on the glow discharge treatment. However, the methods described therein cannot provide adhesion sufficiently strong to be retained in a dry condition and in a processing solution. Further, specific gas such as inert gas, a nitrogen oxide or organic compound gas must be introduced but this is not preferred either in view of cost or environmental conservation. JP-A-59-556430 describes a method where the gas composition in the discharge atmosphere is restricted to gases generated in the container resulting from that, in applying glow discharge treatment to the polymer surface, the polyester support itself is subjected to discharge treatment after the initiation of discharging, however, since the gas composition in the discharge atmosphere varies depending on the width of the polyester support, the conveyance speed or the support temperature at the surface treatment, a stable and adequate adhesive force cannot be obtained. JP-B-60-16614 describes a method where a vacuum glow discharge treatment is conducted at the surface temperature of polyester film of from 80° to 180° C., however, when the polyester support has a glass transition temperature of from 90° to 200° C., a satisfactory adhesive force cannot be obtained by the discharge treatment at a temperature higher than the glass transition temperature of the support.

SUMMARY OF THE INVENTION

A first object of the present invention is to provide a process for producing a silver halide photographic material using a polyester support having good undercoating coatability.

A second object of the present invention is to provide a process for producing a silver halide photographic material using a polyester support having good adhesion and superior mechanical characteristics.

A third object of the present invention is to provide a process for producing a silver halide photographic material having a reduced curling habit and good antistatic performance.

A fourth object of the present invention is to provide a process for producing a small-sized silver halide photographic material showing good adhesion in the production process, having excellent mechanical characteristics and being hard to have a curling habit.

The above-described objects of the present invention have been achieved by a process for producing a silver halide photographic material comprising a polyester support having thereon at least one light-sensitive layer and at least one undercoat layer, wherein a solution containing gelatin for the undercoating binder having a calcium ion ($Ca^{++}$) content of from 10 to 2,500 ppm based on the dry gelatin is coated as the undercoat layer.

DETAILED DESCRIPTION OF THE INVENTION

The polyester support used in the present invention will be described below.

Although the effects of the present invention can be obtained by using any of an aliphatic polyester, an alicyclic compound polyester or an aromatic polyester as the support of the present invention, the aromatic polyester is preferred due to facility in increasing mechanical strength and elevating the glass transition temperature (Tg).

The aromatic polyester which can be used in the present invention is composed of a diol and an aromatic dicarboxylic acid as essential components. The aromatic dicarboxylic acid contains at least one benzene nucleus in the dicarboxylic acid. The aromatic dicarboxylic acid may be used in combination with other dicarboxylic acids such as an aliphatic dicarboxylic acid and examples of the dibasic acid (e.g., an aromatic or aliphatic dicarboxylic acid) which can be used in combination include terephthalic acid, isophthalic acid, phthalic acid, phthalic anhydride, naphthalenedicarboxylic acid (e.g., 2,6-, 1,5-, 1,4-, 2,7-), diphenylene-p,p'-dicarboxylic acid, tetrachlorophthalic anhydride, succinic anhydride, maleic acid, fumaric acid, maleic anhydride, itaconic acid, citraconic anhydride, tetrahydrophthalic anhydride, 3,6-endomethylenetetrahydrophthalic anhydride, 1,4-cyclohexanedicarboxylic acid, terephthalic halide, bis(p-carboxyphenol)ether, 1,1-dicarboxy-2-phenylethylene, 1,4-dicarboxylmethylphenol, 1,3-dicarboxy-5-phenylphenol, sodium 3-sulfoisophthalate (SIP) and 4-sulfo-2,6-naphthalene dicarboxylic acid (SNDCA). The aromatic dicarboxylic acid as an essential component contains at least one benzene nucleus in the above-described dicarboxylic acid.

Examples of the diol include ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcin, hydroquinone, 1,4-benzenedimethanol, dimethylolnaphthalene, p-hydroxyethyloxybenzene and bisphenol A.

If desired, a monofunctional or tri- or greater polyfunctional hydroxy group-containing compound or an acid-containing compound may be copolymerized. The polyester of the present invention may also be copolymerized by a compound such as hydroxycarboxylic acid, e.g., salicylic acid, having in the molecule a hydroxyl group and a carboxyl group (or an ester thereof) at the same time.

Among these diol and dicarboxylic acid monomers, preferred examples of the aromatic dicarboxylic acids include 2,6-naphthalenedicarboxylic acid (NDCA), terephthalic acid (TPA), isophthalic acid (IPA), orthophthalic acid (OPA) and paraphenylenedicaboxylic acid (PPDC), with 2,6-naphthalenedicarboxylic acid (PPDC) being particularly preferred, and preferred examples of the diols include (poly-)ethylene glycol (PEG or EG), cyclohexanedimethanol (CHDM), neopentyl glycol (NPG), bisphenol A (BPA) and biphenol (BP), with ethylene glycol being particularly preferred. Further, examples of the hydroxycarboxylic acid as a copolymer component include those copolymerized by parahydroxybenzoic acid (PHBA) or 6-hydroxy-2-naphthalenecarboxylic acid (NHCA).

Among these, preferred examples of the polymer include a homopolymer such as polyethylene terephthalate, polyethylene naphthalate or polycyclohexanedimethanol terephthalate (PCT) and a copolymer such as a copolymer of terephthalic acid and naphthalenedicarboxylic acid with ethylene glycol (with the mixing molar ratio of terephthalic acid to naphthalenedicarboxylic acid being preferably from 0.9:0.1 to 0.1:0.9, more preferably from 0.8:0.2 to 0.2:0.8), a copolymer of terephthalic acid with ethylene glycol and bisphenol A (with the mixing molar ratio of ethylene glycol to bisphenol A being preferably from 0.6:0.4 to 0:1.0, more preferably from 0.5:0.5 to 0.1:0.9), a copolymer of isophthalic acid, paraphenylenedicarboxylic acid and terephthalic acid with ethylene glycol (with the molar ratios of isophthalic acid and paraphenylenedicarboxylic acid being, relative to terephthalic acid as 1, from 0.1 to 5.0 and from 0.1 to 0.5, respectively, more preferably from 0.2 to 0.3 and from 0.2 to 0.3, respectively), a copolymer of terephthalic acid with neopentyl glycol and ethylene glycol (with the molar ratio of neopentyl glycol to ethylene glycol being preferably from 1:0 to 0.7:0.3, more preferably from 0.9:0.1 to 0.6:0.4), a copolymer of terephthalic acid with ethylene glycol and biphenol (with the molar ratio of ethylene glycol to biphenol being preferably from 0:1.0 to 0.8:0.2, more preferably from 0.1:0.9 to 0.7:0.3) or a copolymer of parahydroxybenzoic acid and ethylene glycol with terephthalic acid (with the molar ratio of parahydroxybenzoic acid to ethylene glycol being preferably from 1:0 to 0.1:0.9, more preferably from 0.9:0.1 to 0.2:0.8). Among these, polyesters containing 2,6-naphthalenedicarboxylate are preferred. More specifically, polyesters containing from 10 to 100 mol % (particularly 30 to 100 mol %) based on the total carboxylic acid of 2,6-naphthalenedicarboxylic acid are preferred, and polyethylene 2,6-naphthalate is most preferred.

These homopolymer and copolymers can be synthesized according to conventionally known production methods of polyester. For example, the acid component can be esterified directly with the glycol component (direct polymerization) or dialkylester used as the acid component is ester-interchanged with the glycol component and then heated under reduced pressure to remove excess glycol component (ester interchange). Or, an acid halide as the acid component may be reacted with glycol. In this case, if desired, an ester interchange catalyst or a polymerization catalyst may be used or a heat resistant stabilizer may be added. The synthesis of these polyesters can be conducted by referring, for example, to *Kobunshi Jikken-qaku*, Vol. 5, "Polycondensation and Polyaddition" published by Kyoritsu Shuppan, pp. 103–136 (1980) and *Gosei Kobunshi V*, published by Asakura Shoten, pp. 187–286 (1971).

The above-described polyester preferably has an average molecular weight of approximately from 5,000 to 200,000.

In order to improve the adhesion to a different kind of polyester, the above-described polyester may be partly blended with a different polyester or may be copolymerized with a monomer constituting the different polyester or a monomer having an unsaturated bond may be copolymerized in the above-described polyester to construct a radical bridge.

A polymer blend as a mixture of two or more polymers produced as above can be easily formed according to the methods described JP-A-49-5482, JP-A-64-4325, JP-A-3-192718, *Research Disclosure Nos.* 283739, 283740 and 283741, ibid., Nos. 284779, 284780, 284781 and 184782, and ibid., Nos. 294807, 294808, 294809, 294810, 294811, 294812, 294813 and 294814.

The polyester of the present invention has a Tg of preferably 90° C. or higher, more preferably from 90° to 200° C.

On the other hand, a polyester film having a general purpose grade, transparency and a Tg exceeding 200° C. has not yet been developed. Accordingly, the polyester used in the present invention is preferred to have a Tg of from 90° to 200° C.

The Tg used here can be defined as follows using a differential scanning calorimetry (DSC). First, in a nitrogen stream, 10 mg of a sample is heated to 300° C. at 20° C./min. and then rapidly cooled to room temperature. Thereafter, it is heated again at 20° C./min and the arithmetical mean of a temperature at which deviation from the base line starts and a temperature at which a new base line is recovered is defined as the Tg.

Specific examples of preferred polyesters used in the present invention is described below, but the present invention is by no means limited to these.

Examples of polyester homopolymer

| | | |
|---|---|---|
| P-0: | [Terephthalic acid (TPA)/ethylene glycol (EG)) (100/100)] (PET) | Tg = 80° C. |
| P-1: | [2,6-Naphthalenedicarboxylic acid (NDCA)/ethylene glycol (EG) (100/100)] (PEN) | Tg = 119° C. |
| P-2: | [Terephthalic acid (TPA)/cyclohexane-dimethanol (CHDM) (100/100)] | Tg = 93° C. |
| P-3: | [TPA/bisphenol A (BPA) (100/100)] | Tg = 192° C. |

Examples of polyester copolymer

| | | |
|---|---|---|
| P-4: | 2,6-NDCA/TPA/EG (50/50/100) | Tg = 92° C. |
| P-5: | 2,6-NDCA/TPA/EG (75/25/100) | Tg = 102° C. |
| P-6: | 2,6-NDCA/TPA/EG/BPA (50/50/75/25) | Tg = 112° C. |
| P-7: | TPA/EG/BPA (100/50/50) | Tg = 105° C. |

-continued

| | | |
|---|---|---|
| P-8: | TPA/EG/BPA (100/25/75) | Tg = 135° C. |
| P-9-1: | TPA/EG/CHDM/BPA (100/25/25/50) | Tg = 115° C. |
| P-9-2: | NCDA/SIP/EG (99/1/100) | Tg = 115° C. |
| P-9-3: | SNDCA/SIP/EG (99/1/100) | Tg = 115° C. |
| P-10: | IPA/PPDC/TPA/EG (20/50/30/100) | Tg = 95° C. |
| P-11: | NDCA/NPG/EG (100/70/30) | Tg = 105° C. |
| P-12: | TPA/EG/BP (100/20/80) | Tg = 115° C. |
| P-13: | PHBA/EG/TPA (200/100/100) | Tg = 125° C. |

Examples of polyester polymer blend

| | | |
|---|---|---|
| P-14: | PEN/PET (60/40) | Tg = 95° C. |
| P-15: | PEN/PET (80/20) | Tg = 104° C. |
| P-16: | PAr/PEN (50/50) | Tg = 142° C. |
| P-17: | PAr/PCT (50/50) | Tg = 118° C. |
| P-18: | PAr/PET (60/40) | Tg = 101° C. |
| P-19: | PEN/PET/PAr (50/25/25) | Tg = 108° C. |
| P-20: | TPA/5-sulfoisophthalic acid (SIP)/EG (95/5/100) | Tg = 65° C. |
| P-21: | PEN/SIP/EG (99/1/100) | Tg = 115° C. |

The abbreviations used in the above stand for the following compounds:

NDCA: 2,6-naphthalenedicarboxylic acid
TPA: terephthalic acid
IPA: isophthalic acid
OPA: orthophthalic acid
PPDC: paraphenylenedicarboxylic acid
EG: ethylene glycol
PEG: polyethylene glycol
CHDM: cyclohexanedimethanol
NPG: neopentyl glycol
BPA: bisphenol A
BP: biphenol
PHBA: parahydroxybenzoic acid
HNCA: 6-hydroxy-2-naphthalenecarboxylic acid
SIP: sulfoisophthalic acid
PCT: polycyclohexanedimethanol terephthalate
PET: polyethylene terephthalate
PAr: polyarylate [TPA/BPA (100/100)]

The support of the present invention has a thickness of from 50 to 300 μm. If the thickness is less than 50 μm, the support cannot endure the shrinkage stress of the light-sensitive layer generated in drying, and, on the other hand, if it exceeds 300 μm, the object to achieve thinning for the miniaturization is largely contradicted. From the viewpoint of toughness, the support is preferred to be thick and the thickness thereof is preferably from 60 to 122 μm, more preferably from 80 to 115 μm, most preferably from 85 to 105 μm.

The above-described supports according to the present invention all have a flexural modulus of elasticity higher than that of TAC and a thin film as the object can be realized. Among these, PET and PEN have a strong flexural elasticity and by using this, the film thickness, which needs to be 122 μm in case of TAC, can be reduced to 105 μm or less.

It is found to be effective to subject the polyester support of the present invention, on which surfaces a light-sensitive layer and a back layer are provided, to surface treatment to impart adhesive property. By effecting surface treatment, the support can have an increased surface energy to reinforce the adhesion with the light-sensitive layer, the back layer or the adhesion layer and in addition, by the use of crosslinking reaction between the support and respective layers, the adhesion can further be increased. Further, by the surface treatment, not only the surface energy is increased but also the support surface can be roughened, whereby an increased adhesion may be expected due to the interfacial mingling with the adhesion layer or the like or the increased adhesion area.

More specifically, in order to firmly bond a photographic layer (e.g., a light-sensitive silver halide emulsion layer, an interlayer, a filter layer, a protective layer, an electrically conductive layer, a back layer) to the support of the present invention, the support may be subjected to surface activation treatment such as glow discharge treatment, ultraviolet treatment, flame treatment, active plasma treatment, corona discharge treatment, ultrasonic treatment, mixed acid treatment or ozone oxidization treatment and then a photographic layer may be coated thereon to achieve adhesion, or after the surface treatment described above or without any surface treatment, an undercoat layer may be provided and then a photographic emulsion layer may be coated thereon. In a preferred method, after the surface is subjected to glow discharge treatment, ultraviolet treatment, flame treatment and corona discharge treatment, an undercoat layer is provided on the support and a photographic layer is provided thereon. In a particularly preferred method, after the support is subjected to glow discharge treatment, an undercoat layer is provided on the support and a photographic layer is provided thereon.

It has been known that the glow treatment is particularly effective among surface treatments for achieving at the same time impartation of adhesive property, suppression of yellowing and prevention of blocking, which the polyester support of the present invention is required to have. The glow discharge treatment may be conducted by introducing various gas such as oxygen, nitrogen, helium or argon into the atmosphere, however, since in case of the polyester support of the present invention, there is found no remarkable effect on the adhesive property by the introduction of the specific gas and the gas is expensive, the introduction of gas is not industrially preferred. On the other hand, when steam is introduced into the atmosphere, the effect on the adhesion is equal or superior to that in the case of introduction of specific gas and the steam is remarkably cheap, and therefore, this technique is industrially excellent.

The gas composition of the discharge atmosphere in glow discharge treatment may be composed only of gases in the container generated as a result of that the support itself is surface-treated on the initiation of discharge as described in JP-A-59-556430, but the glow discharge treatment is preferably conducted in the presence of steam as described in JP-A-6-118561. The steam partial pressure is preferably from 10% to 100%, more preferably from 40% to 90%. The remaining gas other than the steam is an air composed of oxygen, nitrogen and the like. The steam can be quantitatively introduced into the atmosphere of glow discharge treatment by introducing gas from a sampling tube installed to the glow discharge treatment apparatus into a tetrode-type mass spectrograph (MSQ-150, produced Nippon Shinku K.K.) while keeping the quantity of compositions constant.

When the glow treatment is applied to a previously heated support which is to be subjected to surface treatment, the improvement in adhesive property is achieved in a short period of time and the yellowing of the support can be greatly reduced. The temperature in previous heating is preferably from 50° C. to Tg, more preferably from 70° C. to Tg, most preferably from 90° C. to Tg.

The surface temperature of the polymer can be increased in a vacuum, specifically, by heating the polymer with means of an infrared ray heater or by bringing it into contact with a heat roller.

The glow discharge treatment is preferably conducted using a discharge electrode and a discharge treatment apparatus described in Japanese Patent Application No. 5-147864.

The vacuum degree in the glow discharge treatment is preferably from 0.005 to 20 Torr, more preferably from 0.02 to 2 Torr. The voltage is preferably from 500 to 5,000 V, more preferably from 500 to 3,000 V. The discharge frequency used is generally from d.c. to several thousands MHz, preferably from 50 Hz to 20 MHz, more preferably from 1 kHz to 1 MHz.

The discharge treatment strength is preferably from 0.01 to 5 KV.A.min/$m^2$, more preferably from 0.15 to 1 KV.A.min/$m^2$.

It is preferred to decrease the temperature of the support immediately with a cooling roller by a method described in JP-A-3-39106 after the glow discharge treatment. By doing so, the support can be prevented from worsening in planeness due to the plastic deformation by an external force at a high temperature or from worsening with respect to the transparency or blocking resistance ascribable to the precipitation of low molecular substances (e.g., monomer, oligomer) on the support surface. Although the time period from the glow discharge treatment to coating is advantageously as short as possible because problems such as adhesion of dusts are evaded, there is no problem even when the support is allowed to stand for a long period of time, and although the time period is not particularly restricted, it is preferably 1 year or less, more preferably 3 months or less.

The ultraviolet treatment is preferably conducted according to the methods described in JP-B-43-2603, JP-B-43-2604 and JP-B-45-3828. The mercury lamp is a high-pressure mercury lamp made of a silica tube and the wavelength of the ultraviolet ray is preferably from 220 to 380 nm. The ultraviolet ray irradiation may be conducted at any time during stretching, during heat fixing or after heat fixing.

If there arises no problem in view of performance by raising the surface temperature of the support to around 150° C., the light source used can be a high-pressure mercury lamp having a main wavelength of 365 nm. If the treatment at low temperature is needed, a low-pressure mercury lamp having a main wavelength of 254 nm is preferred. An ozoneless-type high-pressure mercury lamp or low-pressure mercury lamp can also be used. The larger the processing light quantity is, the greater the adhesive force between the support and the layer bonded thereto is, however, as the light quantity increases, there arise problems such that the support is colored or the support is rendered brittle. Accordingly, in the case of usual plastic film such as polyester or polyolefin, with a high-pressure mercury lamp having a main wavelength at 365 nm, the irradiation light quantity is preferably from 20 to 10,000 mJ/$cm^2$, more preferably from 50 to 2,000 mJ/$cm^2$, and with a low-pressure mercury lamp having a main wavelength at 254 nm, the irradiation light quantity is generally from 100 to 10,000 mJ/$cm^2$, more preferably from 300 to 1,500 mJ/$cm^2$.

The corona discharge treatment can be conducted using a solid state corona treatment machine, "Model 6KVA" manufactured by Pillar Co., Ltd. The discharge frequency at the treatment is generally from 5 to 40 kHz, preferably from 10 to 30 kHz. The waveform is preferably an a.c. sine wave. The gap clearance between the electrode and the dielectric roller is generally from 1 to 2 mm, preferably from 1.4 to 1.6 mm. The treating amount is generally from 0.3 to 0.4 KV.A-min/$m^2$, preferably from 0.34 to 0.38 KV.A.min/$m^2$.

The flame treatment may be conducted with natural gas or liquified propane gas, however, important is a mixing ratio thereof to an air. In the case of propane gas, a preferred mixing ratio of propane gas/air is, in terms of volume ratio, generally from 1/14 to 1/22, preferably from 1/16 to 1/19. In the case of natural gas, it is generally from 1/6 to 1/10, preferably from 1/7 to 1/9. The flame treating amount is preferably from 1 to 50 Kcal/$m^2$, more preferably from 3 to 20 Kcal/$m^2$. Further, it is more effective to set the distance between the tip of inner flame of a burner and the support to less than 4 cm. The treating apparatus may be a flame treatment apparatus (manufactured by Kasuga Denki K.K.). The backup roller for holding the support at the flame treatment is preferably a hollow-type roller to effect the treatment all the time at a constant temperature while water-cooling the support by passing cooling water through the hollow.

The silver halide photographic light-sensitive layers of the present invention is coated on the polyester support which has been subjected to surface treatment. In order to intensify the adhesion at this time, an undercoat layer comprising gelatin as a binder is preferably provided. The undercoating solution may contain various additives, if desired. Examples thereof include a surfactant, an antistatic agent, a dyestuff for coloring an antihalation agent, a pigment, a coating aid and an antifoggant. The undercoating solution of the present invention may also contain an etching agent such as resorcin, chloral hydrate or chlorophenol.

The undercoat layer of the present invention may contain fine particles of an inorganic substance such as $SiO_2$ or $TiO_2$ or fine particles (size: from 1 to 10 μm) of a polymethyl methacrylate copolymer as a matting agent.

The undercoating solution according to the present invention can be coated by a commonly well known coating method such as dip coating, air knife coating, curtain coating, roller coating, wire bar coating or gravure coating, or by extrusion coating using a hopper described in U.S. Pat. No. 2,681,294. If desired, two or more layers can be coated simultaneously according to the methods described in U.S. Pat. Nos. 2,761,791, 3,508,947, 2,941,898 and 3,526,528 and Yuji Harasaki, *Coating Kogaku*, published by Asakura Shoten, p. 253 (1973).

Examples of the binder for the undercoat layer of the polyester support of the present invention include gelatin, monomers such as vinyl chloride, vinylidene chloride, methacrylic acid, acrylic acid, itaconic acid, maleic anhydride, diolefin monomer, vinyl monomer and a copolymer of these, and nitrocellulose.

The gelatin as a preferred binder of the undercoat layer of the present invention may be lime-processed gelatin, acid-processed gelatin, alkali-processed gelatin, enzyme-processed gelatin prepared by applying enzyme treatment to the gelatin during the production step thereof, gelatin derivative or gelatin processed and modified by a reagent having an amino group, an imino group, a hydroxyl group or a carboxyl group as a functional group in the molecule and a group capable of reacting therewith. With respect to the production method of gelatin, for example, T. H. James, *The Theory of the Photographic Process,* 4th ed., p. 55, Macmillan (1977), *Kagaku Shashin Binran*, Vol. 1, pp. 72–75, Maruzen, and *Shashin Kogaku no Kiso-Gin'en Shashin-hen*, pp. 119–124, Corona Sha can be referred to.

The gelatin used in the undercoat layer of the present invention has a calcium ion ($Ca^{++}$) content of from 10 to 2,500 ppm based on the dry gelatin. More specifically, such the gelatin can be produced by dissolving gelatin in water, removing fat impurities therefrom and then passing the aqueous gelatin solution through the column of a cation exchange resin or bringing it into contact with a cation exchange resin by a batch processing. Examples of the gelatin used in the present invention include acid-processed gelatin produced by treating gelatin with hydrochloric acid or the like during production of gelatin from collagen or ossein as a main ingredient of bone or skin of animals, lime-processed gelatin produced by treating gelatin with lime or the like, a gelatin derivative or modified gelatin with the functional group being substituted and enzyme-treated gelatin. Arther Veise, *The Macromolecular Chemistry of Gelatin*, pp. 187–217, Academic Press (1964) describes on the production method and properties of the above-described gelatin.

An acid added to the organic solvent for swelling gelatin of the present invention will be described.

The organic solvent having good wettability to the polyester support, such as methanol or acetone, cannot alone swell gelatin as a binder of the undercoat layer. Accordingly, in preparing an undercoating solution, gelatin must be first swelled by water. The amount of water is generally from 1 to 10% by volume, preferably from 1 to 5% by volume, more preferably from 1 to 3% by volume, based on the total amount of the undercoating solution, where gelatin swells for from 15 to 60 minutes. When the swelled gelatin is dispersed after heat dissolution, it aggregates and is not dispersed uniformly in a bad solvent (i.e., a poor solvent) of gelatin.

The undercoating of the present invention is characterized in that the organic solvent is added to gelatin through two stages, namely, in the first stage, an organic solvent containing an acid is added. The organic solvent solution containing an acid can be prepared by previously mixing an organic solvent in an amount of from 5 to 15% by volume, preferably from 5 to 10% by volume, based on the organic solvent added at the final stage, with an acid having a pKa (a negative logarithm of acid dissociation constant) in water of from −8.0 to 4.0. This solution is added to gelatin swelled by water and the gelatin is further swelled for about 30 minutes at normal temperature. With respect to the pKa in water of an acid, *Kagaku Bin'ran Kiso-hen* (*ver.* 2) "8.21 *Kagaku Heikou Teisu*", compiled by Nippon Kagaku Kai, pp. 994–996, Maruzen can be referred to. The acid may be either an inorganic compound or an organic compound. The acid has a pKa in water of generally from −8.0 to 4.0, preferably from −8.0 to 3.5, and it is preferably at least one selected from the group consisting of salicylic acid, oxalic acid, hydrochloric acid, sulfuric acid and phosphoric acid in view of undercoating aptitude and safety. If the pKa exceeds 4.0, the gelatin swells insufficiently and is difficult to disperse at a heating step. The addition amount of the acid is generally from 1 to 8 wt %, preferably from 2 to 5 wt %, based on the amount of the organic solvent. When the organic solvent containing an acid is added, the gelatin concentration is adjusted to be generally from 5 to 15 wt %, preferably from 5 to 10 wt %. If it is less than 5 wt % and the organic solvent is the majority, the gelatin is whitened and cannot dissolve at the subsequent heating step. On the other hand, if it exceeds 15 wt %, the swelling rate is small and also the gelatin becomes hard to dissolve at the subsequent heating step.

The gelatin used for the undercoat layer of the present invention has a calcium ion ($Ca^{++}$) content of from 10 to 2,500 ppm, preferably from 20 to 500 ppm, more preferably from 30 to 100 ppm, based on the dry gelatin.

One example of the undercoating solution of the present invention is a solution containing a vinylidene chloride copolymer composed of from 70 to 99.9 wt % of a vinylidene chloride monomer and from 0.1 to 5 wt % of a vinyl monomer having one or more carboxyl group. Examples of the above-described vinyl monomer having one or more carboxyl group include an acrylic acid, a methacrylic acid, an itaconic acid and a citraconic acid. The vinylidene chloride copolymer of the present invention is preferably a water dispersion of a latex. In this case, the latex may be a normal latex having a uniform structure or a so-called core/shell type latex having different structures between the core and the shell of the latex grain.

Another example of the undercoating solution of the present invention is a solution containing a copolymer composed of from 10 to 90 wt % of a diolefin monomer and from 10 to 90 wt % of one or more vinyl monomer.

The diolefin monomer may be either an aliphatic unsaturated hydrocarbon $C_nH_{2n-2}$ (where n is an integer of from 4 to about 20) or a cyclic hydrocarbon $C_nH_{2n-4}$ (where n is an integer). Specific examples thereof include butadiene, isoprene and chloroprene, and among them, butadiene is preferred in view of the adhesion force to the support. The content thereof is preferably from 10 to 90 wt %.

The vinyl monomer as the second ingredient is a monomer for forming a hard segment in the copolymer. Preferred examples thereof include vinyl aromatic, αβ-unsaturated nitrile, methacrylic acid ester, vinyl halide, vinyl ester such as styrene, acrylonitrile and methyl methacrylate, vinyl chloride and vinyl acetate.

The undercoat layer of the present invention may contain polyamide-epihalohydrin resin as a gelatin hardening agent.

Although there is no restriction on the molecular weight of the polyamide-epihalohydrin resin used in the present invention, the molecular weight is preferably from $5\times10^3$ to $1\times10^5$. The polyamide-epihalohydrin resin is suitably a polyamide resin modified with epihalohydrin and it is preferably prepared by reacting a polyamide resin synthesized by the reaction of dibasic carboxylic acid and polyalkylene amine, with epihalohydrin.

The dibasic carboxylic acid may be either saturated or unsaturated dibasic carboxylic acid and specific examples thereof include, as the saturated dibasic carboxylic acid, an alkylene dicarboxylic acid (e.g., oxalic acid, malonic acid, succinic acid, glutaric acid, adipic acid, pimelic acid, suberic acid, azelaic acid, sebacic acid, undecanedicarboxylic acid, dodecanedicarboxylic acid, cyclohexanedicarboxylic acid), and as the unsaturated dibasic carboxylic acid, an alkenyl dicarboxylic acid (e.g., maleic acid, fumaric acid, 2-pentenedicarboxylic acid), an alkinyldicarboxylic acid (e.g., 4-hexinedicarboxylic acid) and an arylenedicarboxylic acid (e.g., phthalic acid, isophthalic acid, terephthalic acid, naphthalenedicarboxylic acid). Among these, those having the total carbon number exclusive of the carboxyl group of from 2 to 8 are preferred and those having the total carbon number exclusive of the carboxyl group of from 2 to 6 are more preferred.

Examples of the polyalkyleneamine include diethylenetriamine, triethylenetriamine, tetraethylenepentamine, pentamethylenehexamine, hexamethyleneheptamine, polyethyleneimine, dipropylenetriamine, tripropylenetetramine, tetrapropylenepentamine and polypropyleneimine.

Examples of the epihalohydrin include epichlorohydrin, epibromohydrin and epiiodohydrin, and among these, epichlorohydrin and epibromohydrin are preferred and epichlorohydrin is most preferred.

The polyamide-epihalohydrin resin used in the present invention has a molecular weight of generally from 5,000 to 100,000, preferably from 8,000 to 80,000, more preferably from 10,000 to 50,000.

Specific examples of preferred polyamide-epihalohydrin resins which can be used in the present invention are set forth below, but the present invention should not be construed as being limited to these specific compounds. The compositional ratio is shown by molar number and the molar number of the carboxylic acid is 1.00 in all cases.

| Compound | Amine | | Carboxylic Acid | EH | Molecular Weight |
|---|---|---|---|---|---|
| PH-1 | DT | 1.00 | adipic acid | 1.00 | $0.3\times10^4$ |
| PH-2 | DT | 1.10 | succinic acid | 1.08 | $4.75\times10^4$ |
| PH-3 | DT | 1.07 | glutaric acid | 1.05 | $3.47\times10^4$ |
| PH-4 | DT | 1.05 | adipic acid | 1.08 | $1.12\times10^4$ |
| PH-5 | DT | 1.05 | adipic acid | 1.08 | $4.69\times10^4$ |
| PH-6 | DT | 1.02 | pimelic acid | 1.00 | $1.54\times10^4$ |
| PH-7 | DT | 1.12 | suberic acid | 1.06 | $2.54\times10^4$ |
| PH-8 | DT | 1.15 | sebacic acid | 1.18 | $1.69\times10^4$ |
| PH-9 | DT | 1.04 | maleic acid | 0.98 | $2.02\times10^4$ |
| PH-10 | DT | 1.03 | phthalic acid | 1.08 | $1.95\times10^4$ |
| PH-11 | TET | 1.10 | succinic acid | 2.08 | $5.90\times10^4$ |
| PH-12 | TET | 1.08 | adipic acid | 2.00 | $1.38\times10^4$ |
| PH-13 | TET | 1.04 | phthalic acid | 2.08 | $3.06\times10^4$ |
| PH-14 | TEP | 1.02 | phthalic acid | 3.08 | $1.37\times10^4$ |
| PH-15 | TEP | 1.08 | succinic acid | 3.18 | $2.24\times10^4$ |
| PH-16 | PEH | 1.04 | succinic acid | 2.81 | $1.24\times10^4$ |
| PH-17 | HEH | 1.07 | succinic acid | 3.01 | $1.12\times10^4$ |
| PH-18 | DPT | 1.10 | succinic acid | 1.05 | $6.45\times10^4$ |
| PH-19 | DPT | 1.02 | glutaric acid | 1.00 | $4.71\times10^4$ |
| PH-20 | TPT | 1.06 | adipic acid | 1.98 | $2.38\times10^4$ |
| PH-21 | TPT | 1.09 | 1,4-cyclohexane-dicarboxylic acid | 2.09 | $2.73\times10^4$ |

The abbreviations for the amine in the abovedescribed compounds correspond to the following diamines.

DT: diethylenetriamine

TET: triethylenetetramine

TEP: tetraethylenepentamine

PEH: pentaethylenehexamine

HEH: hexaethyleneheptamine

DPT: dipropylenetriamine

TPT: tripropylenetetramine

In order to obtain a high molecular polyamide resin, it is particularly effective to additionally add small excess amount of polyamine to a prepolymer obtained by preparatory polymerization of the dibasic carboxylic acid with polyamine each in an accurately equivalent molar amount to further condensate prepolymers with each other. In fact, the polyamide-epihalohydrin obtained by this two-stage condensation has a molecular weight of from 5,000 to 100,000.

Representative synthesis methods of the polyamideepihalohydrin resin which is preferably used in the present invention is described below, but the present invention is by no means limited to these specific synthesis methods.

SYNTHESIS EXAMPLE 1

Synthesis of Compound PH-1:

500 g of diethylenetriamine was dissolved in 222 ml of water and then 632 g of adipic acid was added thereto to dissolve while introducing nitrogen gas. The resulting mixture was heated at a temperature of from 130° to 170° C. for 2.5 hours and from 170° to 225° C. for 1.5 hours to remove 410 ml of water by distillation. The heating bath was removed, the residue was slowly cooled and when the temperature reached from 90° to 110° C., water was added thereto to make the total amount 7,480 ml. To the resulting aqueous polyamide solution, 441 g of epichlorohydrin was added at from 50° to 55° C. while stirring over 1 hour. After the addition, the mixture was stirred at 70° C. for 1 hour. The resulting reaction product was cooled to room temperature and then adjusted to have a pH of 5.5 using 6N hydrochloric acid. Then the product was diluted by water to make the total amount 8,480 ml. Thus, an aqueous solution of polyamide-epichlorohydrin having a solid content of 15% was obtained. The addition amount X represents the solid content amount.

The molecular weight of the polyamide-epihalohydrin resin used in the present invention was determined by a gel permeation chromatography using a water solvent (aqueous GPC method).

The separation column was constructed by connecting TSK-GEL G2500PWXL, TSK-GEL G3000PWXL and TSK-GEL G4000PWXL, (all manufactured by TOSOH), in this order, the detection was made with UV (220 nm) using polyethylene oxide as the standard, and the molecular weight was determined from the calibration curve formed.

SYNTHESIS EXAMPLE 2

Synthesis of Compound PH-2:

103.17 g (1.00 mol) of diethylenetriamine and 50 ml of water were poured in 2 l-volume three-neck flask with a cooling tube, a thermometer and a stirrer and dissolved under a nitrogen stream with stirring. To this container, 118.09 g (1.00 mol) of succinic acid was added in five fractions such that the inner temperature did not exceed 50° C. and after completion of the addition, the mixture was stirred for 20 minutes. The resulting mixture was heated at a temperature of from 120° to 150° C. for 2 hours to remove about 75 g of water by distillation. To this container, 10.32 g (0.10 mol) of diethylenetriamine was added and the mixture was heated at a temperature of from 170° to 210° C. for 2 hours to remove about 4 g of water by distillation. The reaction product was cooled to 140° C. and 1 l of water was added thereto to obtain an aqueous polyamide solution. To the resulting aqueous solution, 99.92 g (1.08 mol) of epichlorohydrin was added dropwise at 50° C. with stirring over 30 minutes. After completion of the addition, the temperature was raised to 65° C. to effect reaction for 1 hour. The reaction product was cooled to room temperature and then adjusted to have a pH of 4.8 using an aqueous solution of 20% hydrochloric acid. The reaction product was diluted with water to make the total amount 1,550 g, thus 1,550 g of an aqueous solution of the object compound PH-2 was obtained.

The addition amount of the polyamide-epihalohydrin resin is generally from 0.5 to 25 wt %, preferably from 1.0 to 1.5 wt %, more preferably from 3.0 to 10 wt %, based on the dry weight of gelatin used as a binder of the undercoat layer.

In the present invention, the undercoating solution preferably contains a nonionic surface active agent for improving the coatability of the undercoating solution. The nonionic surface active agent can achieve improvement in coatability of the undercoating solution without undergoing any inconvenience (e.g., insufficient solubility in an undercoating solution containing an organic solvent, aggregation at an interface of the undercoat layer on coating an emulsion layer) caused when used an anionic, cationic or betaine surface active agent.

Preferred examples of the nonionic surface active agent for use in the present invention include compounds described in U.S. Pat. Nos. 2,982,651, 3,428,456, 3,457,076, 3,454,625, 3,552,972 and 3,655,387, JP-B-51-9610, JP-A-53-29715, JP-A-54-89626, JP-A-58-203435 and Japanese Patent Application No. 57-90909 and Hiroshi Horiguchi, *Shin-kaimen-kasseizai*, Sankyo Shuppan (1975) and Compounds I-5, I-6, I-12, I-13, I-23 and I-31 described in JP-B-3-27099.

Particularly preferred examples of the nonionic surface active agent for use in the present invention include compounds represented by the following formulae (I), (II) and (III). The addition amount of the compound is generally from $1\times10^{-3}$ to 0.5 wt %, preferably from $5\times10^{-2}$ to 0.3 wt %, based on the coating solution.

$$R_1-A-(CH_2CH_2O)_{n1}-H \quad (I)$$

(II)

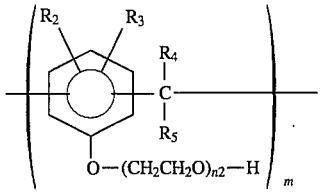

(III)

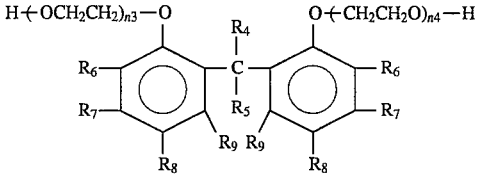

wherein $R_1$ represents a substituted or unsubstituted alkyl, alkenyl or aryl group having from 1 to 30 carbon atoms, A represents —O—, —S—, —COO—, —N($R_0$)—, —CO—N($R_0$)— or —$SO_2$N($R_0$)— (where $R_0$ represents a hydrogen atom or an alkyl group), $R_2$, $R_3$, $R_7$ and $R_9$ each represents a hydrogen atom, a substituted or unsubstituted alkyl, aryl or alkoxy group, a halogen atom, an acyl group, an amido group, a sulfonamido group, a carbamoyl group or a sulfamoyl group, $R_6$ and $R_8$ each represents a substituted or unsubstituted alkyl, aryl or alkoxy group, a halogen atom, an acyl group, an amido group, a sulfonamido group, a carbamoyl group or a sulfamoyl group, with the proviso that the substituents to the phenyl ring in formula (III) may be asymmetric between the left and right moieties, $R_4$ and $R_5$ each represents a hydrogen atom or a substituted or unsubstituted alkyl or aryl group, $R_4$ and $R_5$, $R_6$ and $R_7$ or $R_8$ and $R_9$ may be combined with each other to form a substituted or unsubstituted ring, $n_1$, $n_2$, $n_3$ and $n_4$ each represents an average polymerization degree of ethylene oxide and is a number of from 2 to 50, and m represents an average polymerization degree and is a number of from 2 to 50.

Preferred embodiments of the present invention is described below. $R_1$ is preferably an alkyl, alkenyl or alkylaryl group, and more preferably hexyl, dodecyl, isostearyl, oleyl, t-butylphenyl, 2,4-di-t-butylphenyl, 2,4-di-t-pentylphenyl, p-dodecylphenyl, m-pentadecylphenyl, t-octylphenyl, 2,4-dinonylphenyl or octylnaphthyl.

$R_2$, $R_3$, $R_6$, $R_7$, $R_8$ and $R_9$ each is preferably a substituted or unsubstituted alkyl group having from 1 to 20 carbon atoms such as methyl, ethyl, i-propyl, t-butyl, t-amyl, t-hexyl, t-octyl, nonyl, decyl, dodecyl, trichloromethyl, tribromomethyl, 1-phenylethyl or 2-phenyl-2-propyl; a substituted or unsubstituted aryl group such as phenyl, p-chlorophenyl; a substituted or unsubstituted alkoxy group represented by —$OR_{11}$ (where $R_{11}$ represents a substituted or unsubstituted alkyl or aryl group having from 1 to 20 carbon atoms, hereinafter the same); a halogen atom such as chlorine or bromine; an acyl group represented by —$COR_{11}$; an amide group represented by —$NR_{12}COR_{11}$ (where $R_{12}$ represents a hydrogen atom or an alkyl group having from 1 to 20 carbon atoms, hereinafter the same); a sulfonamide group represented by —$NR_{12}SO_2R_{11}$; a carbamoyl group represented by —$CONR_{12}(R_{13})$ (where $R_{13}$ has the same meaning as $R_{12}$, hereinafter the same) or a sulfamoyl group represented by —$SO_2NR_{12}(R_{13})$, and $R_2$, $R_3$, $R_7$ and $R_9$ each may be a hydrogen atom. $R_6$ and $R_8$ each is preferably an alkyl group or a halogen atom, and more preferably a tertiary alkyl group such as bulky t-butyl, t-amyl or t-octyl. $R_7$ and $R_9$ each is particularly preferably a hydrogen atom. Namely, the compound of formula (III) is particularly preferably synthesized from 2,4-di-substituted phenol.

$R_4$ and $R_5$ each is preferably a hydrogen atom, a substituted or unsubstituted alkyl group such as methyl, ethyl, n-propyl, i-propyl, n-heptyl, 1-ethylamyl, n-undecyl, trichloromethyl and tribromomethyl, or a substituted or unsubstituted aryl group such as α-furyl, phenyl, naphthyl, p-chlorophenyl, p-methoxyphenyl and m-nitrophenyl.

$R_4$ and $R_5$, $R_6$ and $R_7$ or $R_8$ and $R_9$ may be combined with each other to form a substituted or unsubstituted ring such as a cyclohexyl ring. $R_4$ and $R_5$ each is more preferably a hydrogen atom, an alkyl group having from 1 to 8 carbon atom, a phenyl group or a furyl group.

$n_1$, $n_2$, $n_3$ and $n_4$ each is preferably from 5 to 30. $n_3$ and $n_4$ may be the same or different.

Specific examples of the nonionic surface active agent which is preferably used in the present invention are set forth below. Among these, more preferred are Compounds I-5, I-6, I-12, I-13, II-1, III-1 and III-2.

$C_{11}H_{23}COO-(CH_2CH_2O)_8-H$ I-1

$C_{15}H_{31}COO-(CH_2CH_2O)_{15}-H$ I-2

$C_{17}H_{33}COO-(CH_2CH_2O)_{15}-H$ I-3

$C_8H_{17}O-(CH_2CH_2O)_7H$ I-4

$C_{12}H_{25}O-(CH_2CH_2O)_{10}-H$ I-5

$C_{16}H_{33}O-(CH_2CH_2O)_{12}-H$ I-6

$C_{18}H_{35}O-(CH_2CH_2O)_{16}-H$ I-7

$C_{22}H_{45}O-(CH_2CH_2O)_{25}-H$ I-8

I-9

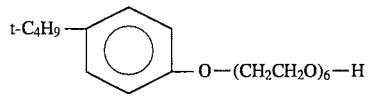

I-10

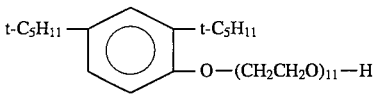

I-11

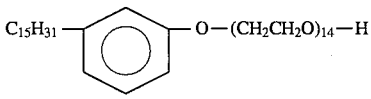

I-12

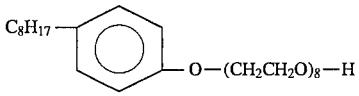

I-13

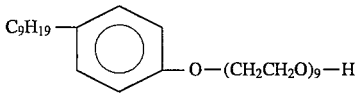

I-14

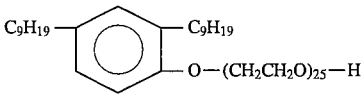

I-15

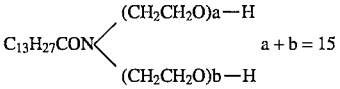

I-16

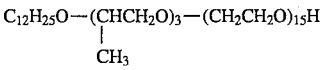

I-17

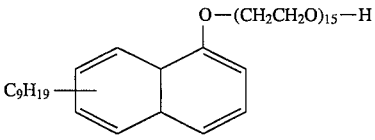

-continued

II-1

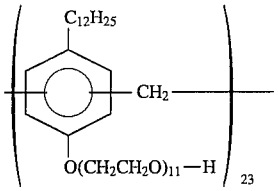

II-2

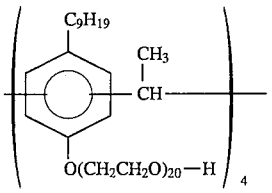

II-3

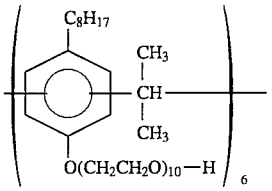

III-1

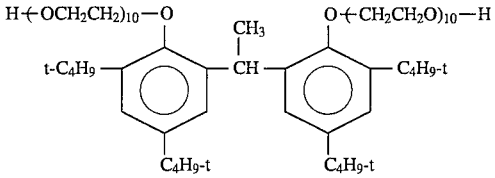

III-2

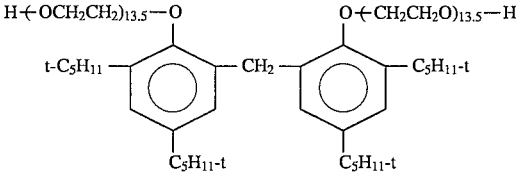

III-3

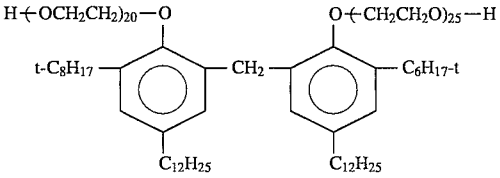

III-4

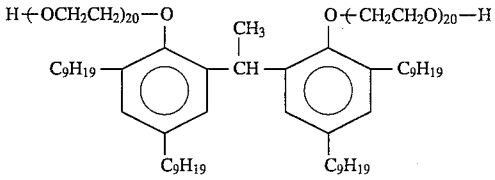

III-5

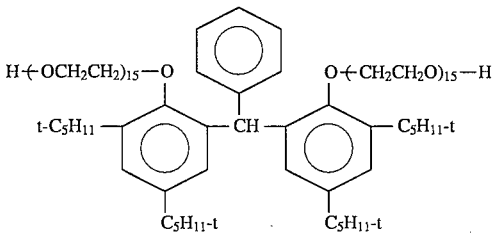

-continued

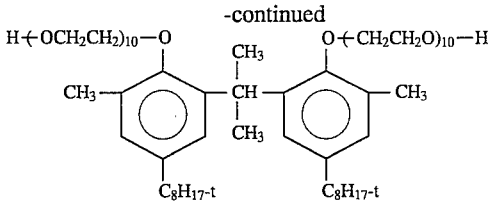

III-6

The undercoat layer of the present invention can contain various known gelatin hardening agents, in addition to the above-described gelatin hardening agent. Examples of such the gelatin hardening agent include chromium salts (e.g., chromium alum), aldehydes (e.g., formaldehyde, glutaraldehyde), isocyanates, cyanuric chloride compounds (e.g., compounds described in JP-B-47-6151, JP-B-47-33380, JP-B-54-2541 and JP-A-56-130740), vinyl sulfone or sulfonyl compounds (e.g., compounds described in JP-B-47-24259, JP-B-50-35807, JP-A-49-24435, JP-A-53-41221 and JP-A-59-18944), carbamoyl ammonium salt compounds (e.g., compounds described in JP-B-56-12853, JP-B-58-32699, JP-A-49-51945, JP-A-51-59625 and JP-A-61-9641), amidinium salt compounds (e.g., compounds described in JP-A-60-225148), carbodiimide compounds (e.g., compounds described in JP-A-51-126125 and JP-A-52-48311), pyridinium salt compounds (e.g., compounds described in JP-B-58-50699, JP-A-52-54427, JP-A-57-44140 and JP-A-57-46538) and other compounds described in Belgian Patent 825,726, U.S. Pat. No. 3,321,313, JP-A-50-38540, JP-A-52-93470, JP-A-56-43353 and JP-A-58-113929.

The silver halide emulsion layer, interlayer, filter layer, protective layer, electrically conductive layer and back layer constituting the photographic material of the present invention each is mainly composed of a hydrophilic colloid layer. Examples of the binder for the hydrophilic colloid layer include, the same as the binder for the undercoat layer, proteins such as gelatin, colloidal albumin and casein; cellulose compounds such as carboxymethyl cellulose and hydoxyethyl cellulose; sugar derivatives such as agar-agar, sodium alginate and starch derivative; and synthetic hydrophilic colloid such as polyvinyl alcohol, poly-N-vinyl pyrrolidone, polyacrylic acid copolymer, polyacrylamide, derivatives or partial hydrolysates of these, dextran, polyvinyl acetate, polyacrylic ester and rosin. The colloid may be used in combination of two or more of these, if desired.

The heat treatment of the support of the present invention is described.

The minimum core diameter in the conventional 135 system is 14 mm. The reduction of the diameter to from 5 to 11 mm is associated by a curling habit of the support even when the polyester support of the present invention is used, which gives rise to conveyance troubles in development.

If the outer diameter is less than 5 mm, the photographic emulsion undergoes pressure fogging and accordingly, the spool cannot be made smaller than 5 mm in diameter.

Thus, the core diameter is preferably from 5 to 11 mm.

The present inventors have found that if the polyester support of the present invention used for preparing a film is subjected to heat treatment at a temperature of from 50° C. to less then Tg, the support having a curling habit with difficulty can be obtained.

The Tg is determined using a differential scanning calorimetry (DSC). First, 10 mg of a sample is heated to 300° C. in a nitrogen stream at 20° C./min., then rapidly cooled to room temperature and heated again at 20° C./min, and the arithmetical mean of a temperature at which deviation from the base line starts and a temperature at which a new base line is recovered is defined as the Tg.

This heat treatment renders the support difficult to have a curling habit by reducing the free volume in the support. The polyester support is usually quenched from not lower than Tg to not higher than Tg after film formation, stretching and heat fixing. The rapidly cooled support is fixed in the state where a large free volume provided at a temperature of Tg or higher is maintained and accordingly, the support easily have a curling habit. And, by heat treating the support at a temperature of Tg or lower, it is transferred into an equilibrium with the free volume being reduced and can have a curling habit with difficulty.

The heat treatment is conducted at a temperature of preferably from 50° C. to less than Tg, more preferably from (Tg −20)° C. to less than Tg. If it is conducted at less than 50° C., a long time is required to achieve a sufficient effect on the curling habit to thereby lower the industrial productivity.

The heat treatment may be conducted, within the above-described temperature range, at a constant temperature or while cooling. In cooling, the average cooling rate is preferably from −0.01° to −20° C./hour, more preferably from −0.1° to −5° C./hour.

The heat treatment time is preferably from 0.1 to 1,500 hours, more preferably from 0.5 to 200 hours. If it is less than 0.1 hour, a sufficient effect cannot be achieved, whereas if it exceeds 1,500 hours, the effect may be saturated but the support is readily colored or rendered brittle.

In order to achieve greater effects on the prevention of a curling habit, before this heat treatment, the support is preferably subjected to heat treatment at a temperature of from Tg to less than the melting point (the melting temperature determined by DSC) to eliminate the heat history of the support and then, it is again subjected to the above-described heat treatment at a temperature of from 50° C. to less than Tg.

In the present invention, the heat treatment at a temperature of from Tg to less than the melting point here is referred to as "pre-heat treatment" and the above-described heat treatment at a temperature of from 50° C. to less than Tg is referred to as "post-heat treatment" for the purpose of discrimination.

The pre-heat treatment is preferably conducted at a temperature of from Tg to less than the melting point, more preferably from (Tg+20)° C. to the crystallization temperature (the crystallization temperature determined by DSC), for from 5 minutes to 3 hours. If the pre-heat treatment is conducted at a temperature higher than the melting point, the elasticity of the support is conspicuously lowered to cause problems on the face property and the conveyability. The pre-heat treatment may be conducted, within the above-described temperature range, at a constant temperature (constant-temperature pre-heat treatment), by lowering the temperature (down-temperature pre-heat treatment) or by raising the temperature (up-temperature pre-heat treatment).

The pre-heat treatment time is preferably from 0.1 minute to 1,500 hours, more preferably from 1 minute to 1 hour. If it is less than 0.1 minute, a sufficient effect cannot be obtained, whereas if it exceeds 1,500 hours, the effect may be saturated but the support is readily colored or rendered brittle.

After the pre-heat treatment, the post-heat treatment is conducted, where the temperature at the completion of pre-heat treatment may be rapidly lowered to the initiating temperature of the post-heat treatment or may be gradually lowered through Tg to the initiating temperature of the post-heat treatment. Or, after once lowered to room temperature, the temperature may be raised to the post-heat treatment temperature.

The post-heat treatment is conducted at a temperature of preferably from 50° C. to less than Tg, more preferably from (Tg–20)° C. to less than Tg. If it is conducted at less than 50° C., a long time is required to achieve a sufficient effect on the curling habit to thereby lower the industrial productivity.

The post-heat treatment may be conducted, within the above-described temperature range, at a constant temperature (constant-temperature post-heat treatment) or by lowering the temperature [cooling] (down-temperature post-heat treatment). In cooling, the average cooling rate is preferably from –0.01° to –20° C./hour, more preferably from –0.1° to –5° C./hour. The post-heat treatment time is preferably from 0.1 to 1,500 hours, more preferably from 0.5 to 200 hours. If it is less than 0.1 hour, a sufficient effect cannot be achieved, whereas if it exceeds 1,500 hours, the effect may be saturated but the support is readily colored or rendered brittle.

Several combinations of the pre-heat treatment and the post-heat treatment may be considered but it is preferred to conduct a constant-temperature pre-heat treatment at a temperature of from (Tg+20)° C. to the crystallization temperature and then a post-heat treatment under cooling to a temperature of from (Tg–20)° C. to Tg at a cooling rate of from –0.1° to –5° C./hour.

The heat treatment of the support may be conducted by conveying the support in the roll form (A) or the web form (B).

In the case when a rolled support (A) is heat treated, the method may be either (1) a method where the roll is heat treated at room temperature or in a thermostat or (2) a method where a predetermined temperature is reached during conveying a web and then after taken up in the roll form, the support is heat treated. In the method (1), although it takes a time to raise or lower the temperature, the equipment investment is advantageously small. In the method (2), although the equipment for the taking up at a high temperature is necessary, the method advantageously dispenses with the time for raising the temperature.

However, the heat treatment of a rolled support is disadvantageous in that since the heat shrinkage stress is generated during the heat treatment, wrinkles due to intensified winding or face troubles such as cut end mark at the core portion are readily caused. Accordingly, it is preferred to render the surface uneven (for example, by coating an electrically conductive inorganic fine particles such as $SnO_2$ or $SbO_2$) to reduce the creak between supports to thereby prevent wrinkles ascribable to the intensified winding, or to provide a roulette on the edges of the support to raise the height slightly only at the edge portions to thereby prevent the cut end mark at the core portion.

On the other hand, in the case where the support in the web form is heat treated, vast and long post-heat treatment step may be required but the support can have good face property as compared with that obtained in the heat treatment of the support in the roll form.

Of these heat treatments, the pre-heat treatment is preferably conducted on the support in the web form and the post-heat treatment is preferably conducted on the support in the roll form. This is because when the pre-heat treatment is applied to the support in the web form, the face property is rather insusceptible to troubles as compared with the case where it is applied to the support in the roll film, and because the post-heat treatment requires a relatively long period of time.

These heat treatments may be conducted at any stage after film formation of the support, after glow discharge treatment, after coating of the back layer (e.g., antistatic agent, sliding agent) and after coating of the undercoating solution but they are preferably conducted after coating of an antistatic agent to prevent dusts, which causes face troubles on the support during heat treatments, from attaching due to electrification.

Further, in conducting heat treatment of the polyester of the present invention, the support is particularly preferably subjected in advance to short-time heating to Tg or higher (preferably to from (Tg+20)° C. to the crystallization temperature for 5 minutes to 3 hours). The roll core used in the heat treatment also preferably has a hollow structure to achieve efficient propagation of the temperature to film or a structure having an internal electric heater or capable of flowing high temperature liquid so that heating can be effected. Although there is no particular restriction on the material of the roll core, materials free of reduction in strength or deformation due to the heat are preferred and examples thereof include stainless steel, aluminum and resin containing glass fiber. The core may be lined with rubber or a resin, if desired.

Further, an ultraviolet absorbent may also be added to the polymer film for the purpose of giving aging stability. The ultraviolet absorbent preferably has no absorption in the visible region and it is usually added in an amount of approximately from 0.5 wt % to 20 wt %, preferably from 1 wt % to 10 wt %, based on the weight of polymer film. If the addition amount is less than 0.5 wt %, deterioration by the ultraviolet light cannot be suppressed. Examples of the ultraviolet absorbent include a benzophenone ultraviolet absorbent such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone and 2,2'-dihydroxy-4,4'-dimethoxybenzophenone; a benzotriazole ultraviolet absorbent such as 2-(2'-hydroxy-5-methylphenyl)benzotriazole, 2-(2'-hydroxy-3',5'-di-t-butylphenyl)benzotriazole and 2-(2'-hydroxy-3'-di-t-butyl-5'-methylphenyl)benzotriazole; and a salicylic acid ultraviolet absorbent such as phenyl salicylate and methyl salicylate.

The polyester, particularly, the aromatic polyester has a high refractive index as from 1.6 to 1.7, whereas gelatin as a main component of the light-sensitive layer provided on the polyester has a refractive index lower than this as from 1.50 to 1.55, and accordingly, when a light enters from the film edge, it reflects at the interface between the base and the emulsion layer to cause a so-called light piping phenomenon (edge fogging).

In order to evade such a light piping phenomenon, a method where inactive inorganic particles or the like are incorporated into the film and a method where a dyestuff is added are known. Since the addition of a dyestuff does not extremely increase a film haze, the addition of the dyestuff is preferred.

The dyestuff used for coloring film preferably has a grey color tone in view of general properties of the photographic material, superior heat resisting property in the temperature region where the polyester film is produced and excellent compatibility with polyester.

Such a dyestuff can be prepared by mixing commercially available dyestuffs for polyester such as DIARESIN produced by Mitsubishi Chemical Industries, Ltd. and KAYASET produced by Nippon Kayaku K.K.

The polyester support of the present invention can be imparted with slipperiness according to the end use and in this concern, a generally known technique is the mixing of an inactive inorganic compound or the coating of a surface active agent.

Examples of the inactive inorganic particle include $SiO_2$, $TiO_2$, $BASO_4$, $CaCO_3$, talc and kaolin. As described above, the slipperiness can be imparted by the external particle system where inactive particles are added to the polyester synthesis reaction system and in addition, the slipperiness can be imparted by an inner particle system where a catalyst and the like added during the polymerization of polyester are precipitated.

In the external particle system, $SiO_2$ is preferred because it has a refractive index relatively close to that of the polyester film, and in the inner particle system, compounds capable of having a relatively small particle size when precipitated are preferred.

Further, it is preferred to laminate a layer which is imparted with a function to achieve high transparency of film. Specific examples of the technique to this effect include a plurality of extruders or coextrusion by feedblock or multimanifold die.

The silver halide photographic material of the present invention is preferably imparted with antistatic function.

To this effect, an electrically conductive layer (namely, antistatic layer) can be provided as a photographic layer in the present invention.

The electrically conductive layer (antistatic layer) may be provided on the silver halide emulsion layer side of the support or on the back layer side opposite to the silver halide emulsion layer side.

The most preferred antistatic agent for use in the antistatic layer, namely, an electrically conductive layer, of photographic layers is fine particles of at least one crystalline metal oxide selected from the group consisting of ZnO, $TiO_2$, $SnO_2$, $Al_2O_3$, $In_2O_3$, $SiO_2$, MgO, BaO, $MoO_3$ and $V_2O_5$ and of a composite oxide of these. Among these, particularly preferred is an electrically conductive material comprising $SnO_2$ as a main component, approximately from 5 to 20% of antimony oxide and/or other ingredients (e.g., silicon oxide, boron, phosphorus). The fine particle of the electrically conductive crystalline oxide or a composite oxide thereof has a volume resistivity of preferably $10^7$ Ωcm or less, more preferably $10^5$ Ωcm or less. The particle size thereof is preferably from 0.002 to 0.7 μm, more preferably from 0.005 to 0.3 μm.

The electrically conductive layer may be provided on the silver halide emulsion layer side of the support or in the back layer on the opposite side to the silver halide emulsion layer. The binder used is not particularly limited and it may be either an aqueous binder or an organic solvent binder, or may be crosslinked like a latex. Examples of the hydrophilic binder include gelatin, a gelatin derivative, agar-agar, sodium alginate, starch, polyvinyl alcohol, a polyacrylic acid copolymer, a maleic anhydride copolymer, carboxymethyl cellulose and hydroxyethyl cellulose. Examples of the hydrophobic binder include a cellulose ester (e.g., nitrocellulose, diacetylcellulose, triacetylcellulose, methylcellulose), a vinyl polymer containing vinyl chloride, vinylidene chloride or vinyl acrylate, and a polymer such as polyamide and polyester. Among these, preferred are gelatin, methylcellulose and a polyacrylic acid copolymer, Examples of the ingredient for the polyacrylic acid copolymer include methyl acrylate, ethyl acrylate, butyl acrylate, methyl methacrylate and N,N-dimethylaminoethyl acrylate, each in a freely selected molar ratio. The copolymer has a glass transition temperature of preferably from −50° C. to 50° C., more preferably from −30° C. to 30° C. If the glass transition temperature exceeds this range, the adhesive performance as a binder becomes problematic, whereas if it is less than this range, there arises a problem with respect to the blocking resistance of the support in the roll state. More specifically, a copolymer of methyl acrylate, ethyl acrylate, methyl methacrylate and N,N-dimethylaminoethyl acrylate (the molar ratio of methyl acrylate, ethyl acrylate, methyl methacrylate and N,N-dimethylaminoethyl acrylate being preferably 10–50:10–50:10–50:0–5, more preferably 30–40:30–40:30–50:0–3) is preferred. In particular, a latex of a polyacrylic acid copolymer having a viscosity of 100 cp or less is preferred.

The antistatic layer has a volume resistivity of preferably from $10^3$ to $10^{12}$ Ωcm, more preferably from $10^3$ to $10^{10}$ Ωcm, most preferably from $10^3$ to $10^9$ Ωcm.

Irrespective of an organic composition or an aqueous composition, the antistatic layer of the present invention is coated in a specific amount to render the concentration of the electrically conductive material high as much as possible. More specifically, it is effective to coat the electrically conductive material in a high concentration as much as possible so as to improve the antistatic performance and reduce the drying load, however, if the concentration is excessively high, the coating may become uneven or the electrically conductive material may be splashed from the coated film to seriously impair the photographic property, thus the excessively high concentration is not preferred. This problem may be solved to a certain degree by reducing the solid content of the composition and increasing the coating amount of the solution, however, the drying load is intensified and also, particularly in the case of an organic composition, a danger such as explosiveness may be increased, thus, this technique being disadvantageous. Accordingly, the concentration of the solvent of the present invention is preferably from 50 wt % to less than 100 wt %, more preferably from 60 wt % to less than 96 wt %, most preferably from 70 wt % to less than 95 wt %. The concentration of the electrically conductive material is, in terms of solids, preferably from 1 wt % to less than 20 wt %, more preferably from 2 wt % to less than 10 wt %, most preferably from 4 wt % to less than 8 wt %. The coating amount of the solution is preferably from 2 to 10 ml/$m^2$, more preferably from 2 to 8 ml/$m^2$.

The antistatic layer may be provided at any time after the preparation of the support to the coating of silver halide emulsion layers, however, for the purpose of improvement in adhesion of the layer provided, the antistatic layer is preferably provided after the glow discharge treatment. The present invention is characterized in that the antistatic layer is provided before heat treatment, which is advantageous because the supports in contact with each other during heat treatment can be prevented from blocking. Accordingly, in a more preferred embodiment, the antistatic layer is provided after glow discharge treatment and then the support is subjected to heat treatment.

The light-sensitive layer of the silver halide photographic material according to the present invention will be described below.

The light-sensitive layer may be any light-sensitive layer for color negative, color reversal, black-and-white, indirect X-ray or graphic arts film. The description here is made on a general color negative film.

The photographic material of the present invention is enough if at least one of a blue-sensitive silver halide emulsion layer, a green-sensitive silver halide emulsion layer and a red-sensitive silver halide emulsion layer is provided on a support and the number of the silver halide emulsion layers as well as light-insensitive layers and the arrangement order of layers are not particularly restricted. A typical example is a silver halide photographic material comprising a support having thereon at least one light-sensitive layer composed of a plurality of silver halide emulsion layers having substantially the same color sensitivity but different light sensitivities, wherein the light-sensitive layer is a unit light-sensitive layer having color sensitivity to any of blue light, green light and red light. In the case of a multi-layer silver halide color photographic material, generally, a red-sensitive unit layer, a green-sensitive unit layer and a blue-sensitive unit layer are provided in this order from the support side. However, depending upon the end use, the above arrangement order may be reversed or a layer having different light sensitivity may intervene between layers having the same color sensitivity.

A light-insensitive layer such as an interlayer for respective layers may be provided between the above-described silver halide light-sensitive layers, as an uppermost layer or as the lowermost layer.

The interlayer may contain couplers and DIR compounds as described in JP-A-61-43748, JP-A-59-113438, JP-A-59-113440, JP-A-61-20037 and JP-A-61-20038 and also a color mixing inhibitor as usually employed.

A plurality of silver halide emulsion layers constituting each unit light-sensitive layer is described in German Patent No. 1,121,470, British Patent 923,045, JP-A-57-112751, JP-A-62-200350, JP-A-62-206541, JP-A-62-206543, JP-A-56-25738, JP-A-62-63936, JP-A-59-202464, JP-B=55-34932 and JP-B-49-15495.

The silver halide grain may have a regular crystal from such as cubic, octahedral or tetradecahedral, an irregular crystal form such as spherical or tabular, a crystal defect such as twin, or a composite form of these.

The silver halide grain may be fine grains having a grain size of about 0.2 micron or less or large-sized grains having a grain size in terms of a projected area diameter up to about 10 microns, or it may be either a polydispersed emulsion or a monodispersed emulsion.

The silver halide photographic emulsion which can be used in the present invention can be prepared according to the methods described, for example, in *Research Disclosure* (RD) No. 17643, pp. 22–23 "I. Emulsion Preparation and Types" (December, 1978), ibid., No. 18716, p. 648 (November, 1979), P. Glafkides, *Chemie et Physique Photographique*, Paul Montel (1967), G. F. Duffin, *Photographic Emulsion Chemistry*, Focal Press (1966), and V. L. Zelikman et al., Making and Coating *Photographic Emulsion*, Focal Press (1964).

The monodispersed emulsions described in U.S. Pat. Nos. 3,574,628 and 3,655,394 and British Patent 1,413,748 are also preferably used.

Also, tabular grains having an aspect ratio of about 5 or more can be used in the present invention. The tabular grain can be easily prepared by the method described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The crystal structure may be homogeneous, may comprise different halide compositions between the interior and the exterior or may have a layered structure, or silver halides having different compositions may be conjugated by an epitaxial junction or the silver halide may be conjugated with a compound other than silver halide, such as silver rhodanide or lead oxide.

A mixture of grains having various crystal forms may also be used.

The silver halide emulsion is usually subjected to physical ripening, chemical ripening and spectral sensitization before use. The present invention is extremely effective particularly when an emulsion sensitized by a gold compound and a sulfur-containing compound is used. The additives used in these steps are described in *Research Disclosure* Nos. 17643 and 18716 and the pertinent portions thereof are summarized in the table below.

Known photographic additives which can be used in the present invention are also described in the above-described two *Research Disclosures* and the portions of relevant disclosures are shown in the table below.

| | Kinds of Additives | RD17643 | RD18716 |
|---|---|---|---|
| 1 | Chemical sensitizer | p. 23 | p. 648, right column |
| 2 | Sensitivity increasing agent | | p. 648, right column |
| 3 | Spectral sensitizer, supersensitizer | pp. 23–24 | p. 648, right column-p. 649, right column |
| 4 | Brightening agent | p. 24 | |
| 5 | Antifoggant and stabilizer | pp. 24–25 | p. 649, right column |
| 6 | Light absorbent, filter dye, UV absorbent | pp. 25–26 | p. 649, right column-p. 650, left column |
| 7 | Stain inhibitor | p. 25, right column | p. 650, from left to right columns |
| 8 | Dye image stabilizer | p. 25 | |
| 9 | Hardening agent | p. 26 | p. 651, left column |
| 10 | Binder | p. 26 | p. 651, left column |
| 11 | Plasticizer, lubricant | p. 27 | p. 650, left column |
| 12 | Coating aid, surface active agent | pp. 26–27 | p. 650, right column |

Further, in order to prevent deterioration in the photographic performance due to formaldehyde gas, a compound capable of reacting with formaldehyde to fix it described in U.S. Pat. Nos. 4,411,987 and 4,435,503 is preferably added to the photographic material.

Various color couplers can be used in the present invention and specific examples thereof are described in patents cited in the above-described *Research Disclosure* (RD) No. 17643, VII-C to G.

As the yellow coupler, those described, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and European Patent 249,473A are preferred.

Preferred magenta couplers are 5-pyrazolone and pyrazoloazole compounds and those described in U.S. Pat. Nos. 4,310,619 and 4,351,897, European Patent 73,636, U.S. Pat. Nos. 3,061,432 and 3,725,067, *Research Disclosure* No. 24220 (June, 1984), JP-A-60-33552, *Research Disclosure* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO(PCT)88/04795 are particularly preferred.

The cyan coupler includes phenol and naphthol couplers and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent OLS No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199, and JP-A-61-42658 are preferred.

As the colored coupler which corrects unnecessary absorption of the coloring dye, those described in *Research Disclosure* No. 17643, Item VII-G, U.S. Pat. No. 4,163,670, JP-B-57-39413, U.S. Pat. Nos. 4,004,929 and 4,138,258, and British Patent 1,146,368 are preferred.

As the coupler which provides a dye having an appropriate diffusibility, those described in U.S. Pat. No. 4,366,237, British Patent 2,125,570, European Patent 96,570, and West German Patent (OLS) No. 3,234,533 are preferred.

Typical examples of the polymerized dye forming coupler are described in U.S. Pat. Nos. 3,451,820, 4,080,211, 4,367,282, 4,409,320 and 4,576,910, and British Patent 2,102,137.

Couplers which release a photographically useful residue on coupling are also preferably used in the present invention. Preferred DIR couplers which release a development inhibitor are described in patents cited in the above-described RD 17643, Item VII-F, JP-A-57-151944, JP-A-57-154234, JP-A-60-184248, JP-A-63-37346, and U.S. Pat. No. 4,248,962.

As the coupler which imagewise releases a nucleating agent or a development accelerator at development, those described in British Patents 2,097,140 and 2,131,188, JP-A-59- 157638, and JP-A-59-170840 are preferred.

Other couplers which can be used in the photographic material of the present invention include competing couplers described in U.S. Pat. No. 4,130,427, polyequivalent couplers described in U.S. Pat. Nos. 4,283,472, 4,338,393 and 4,310,618, DIR redox compound releasing couplers, DIR coupler releasing couplers, DIR coupler releasing redox compounds or DIR redox releasing redox compounds described in JP-A-60-185950 and JP-A-62-24252, couplers which release a dye capable of color restoration after being released described in European Patent 173,302A, couplers which release a bleaching accelerator described in R.D. No. 11449, ibid., 24241, and JP-A-61-201247, ligand-releasing couplers described in U.S. Pat. No. 4,553,477, and couplers which release a leuco dye described in JP-A-63-75747.

The coupler used in the present invention can be incorporated into the photographic material by various known dispersion methods.

Examples of the high boiling point solvent used in an oil-in-water dispersion method are described in U.S. Pat. No. 2,322,027.

Specific examples of the high boiling point organic solvent having a boiling point of 175° C. or higher under normal pressure which is used in an oil-in-water dispersion method include phthalic esters, phosphoric or phosphonic esters, benzoic esters, amides, alcohols or phenols, aliphatic carboxylic esters, aniline derivatives and hydrocarbons. As the auxiliary solvent, an organic solvent having a boiling point of generally about 30° C. or higher, preferably from 50° C. to about 160° C., can be used and typical examples thereof include ethyl acetate, butyl acetate, ethyl propionate, methyl ethyl ketone, cyclohexanone, 2-ethoxyethylacetate and dimethylformamido.

The process and effects of the latex dispersion method and specific examples of the latex for impregnation are described in U.S. Pat. No. 4,199,363, and West German Patent (OLS) Nos. 2,541,274 and 2,541,230.

The photographic material of the present invention preferably has a total thickness of entire hydrophilic colloid layers on the side having emulsion layers of 28 μm or less and a layer swelling speed $T_{1/2}$ of 30 seconds or less. The thickness herein used means the thickness determined at 25° C. and 55% RH (relative humidity) under humidity conditioning for 2 days and the layer swelling speed $T_{1/2}$ can be determined according to the method known in the art. For example, it can be measured using a swellometer of the type described in A. Green et al., *Photographic Science and Engineering*, Vol. 19, No. 2, pp. 124–129. $T_{1/2}$ is defined as the time required to reach a half of the saturated film thickness which corresponds to 90% of the maximum swelled film thickness achieved in the processing with a color developer at 30° C. for 3 minutes and 15 seconds.

The swelling speed $T_{1/2}$ can be controlled by adding a hardening agent to gelatin as a binder or by changing the aging condition after coating. Also, the swelling ratio is preferably from 150 to 400%. The swelling ratio can be calculated by the equation: (maximum swelled film thickness— film thickness)/film thickness, from the maximum swelled film thickness reached under the condition described above.

The color photographic material according to the present invention can be developed by common methods described in the above-described *RD* No. 17643, pp. 28–29 and ibid. No. 18716, p. 615, from left to right columns.

The silver halide color photographic material of the present invention may contain a color developing agent for the purpose of simplification and speeding up of the processing. The color developing agent is preferably incorporated into the photographic material in the form of a precursor of various type. Examples of the precursor include indoaniline compounds described in U.S. Pat. No. 3,342,597, Schiff base-type compounds described in U.S. Pat. No. 3,342,599, *Research Disclosure* No. 14850 and ibid. No. 15159, and compounds described in ibid. No. 13924.

In the present invention, it is preferred to impart unevenness to the surface of the photographic material so as to improve poor adhesion under high temperatures and high humidities and the rougher surface is better.

The average height of protrusions on the surface in the emulsion side and/or back side is generally from 0.02 to 10 μm, preferably from 0.05 to 5 μm.

The larger number of protrusions on the surface is better, but too many protrusions cause a problem of haze.

As long as the average protrusion height of the present invention is satisfied, the protrusion formed, for example, from spherical or amorphous matting agent is contained in an amount of preferably from 0.5 to 600 mg/m$^2$, more preferably from 1 to 400 mg/m$^2$.

The matting agent used in this case is not particularly restricted in its composition and it may be an inorganic or organic material or a mixture of two or more.

The grain used in the present invention may remain in the photographic material after development or may be dissolved in a processing solution, and when it is dissolved in the processing solution, the grain preferably contains a group capable of being dissolved in an alkaline condition.

Examples of the inorganic or organic compound for the matting agent of the present invention include fine particles of an inorganic material such as barium sulfate, manganese colloid, titanium dioxide, strontium barium sulfate and silicon dioxide, silicon dioxide such as synthetic silica obtained, for example, by a wet method or gelation of silicic acid, and titanium dioxide (rutile or anatase) formed from titanium slug and sulfuric acid. Further, the compound may be obtained by pulverizing an inorganic material having a relatively large grain size, for example, of 20 μm or more, and classifying (shake filtration, air separation) the pulverized material. In addition, a pulverized and classified product of an organic polymer compound such as polytetrafluoroethylene, cellulose acetate, polystyrene, polymethyl methacrylate, polypropyl methacrylate, polymethyl acrylate, polyethylene carbonate and starch may also be used. Further, a polymer compound synthesized by suspension polymerization, a polymer compound rendered spherical by spray drying or dispersion or an inorganic compound may also be used.

Furthermore, a polymer compound as a polymer of monomer compounds or two or more monomer compounds may be formed into grains by various means.

The polymer may be formed from single monomer or a plurality of monomers in combination may be formed into copolymer grains. Among monomer compounds, acrylic esters, methacrylic esters, vinyl esters, styrenes and olefines are preferred.

In the present invention, grains having a fluorine atom or a silicon atom as described in JP-A-62-14647, JP-A-62-17744 and JP-A-62-17743 may also be used.

Among these, preferred examples of the grain composition include polystyrene, polymethyl(meth)acrylate, polyethyl acrylate, poly(methyl methacrylate)/methacrylic acid (95/5 or 50/50 by molar ratio), poly(styrene)/styrene sulfonic acid (95/5 or 60/40 by molar ratio), polyacrylonitrile, poly(methyl methacrylate)/ethyl acrylate/methacrylic acid (50/40/10 by molar ratio) and silica.

Further, grains having a reactive (in particular, gelatin) group described in JP-A-64-77052 and European Patent 307855 can also be used as the grain of the present invention.

The matting agent has an average grain size of preferably from 0.01 to 25 μm, more preferably from 0.1 to 20 μm.

Although there is no particular restriction on the layer to which the matting agent is incorporated, an emulsion protective layer, a back layer and a back protective layer are preferred. Among these, emulsion and back protective layers are preferred and the protective layer has a thickness of from 0.05 to 6 μm, preferably from 0.15 to 5 μm.

EXAMPLE 1

1) Preparation of support

Pellets of compounds PEN, PET, PAr or PCT used in this Example were previously dried at 150° C. for 4 hours. In each support formed by mixing the compounds at a ratio shown in Table 1, simple pellets were first mixed at a ratio as shown in Table 1 and then extruded at 280° C. using a biaxial knead-extruder, followed by pelletization. To these solid contents of polyester, the following Compound (I-6) and Compound (I-24) were added as dyes each in an amount of 54 ppm and dried by a usual method.

Each of these pellets were molten at 300° C., extruded from a T-type die, longitudinally stretched at (Tg+30)° C. to 3.1 times, then transversely stretched at (Tg+20)° C. to 3.5 times and subjected to heat fixing at 250° C. for 6 seconds to form a biaxially stretched polyester support having a thickness of 90 μm.

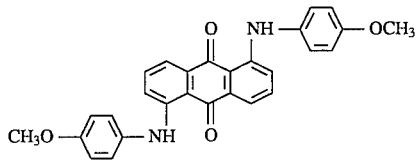

(I-6)

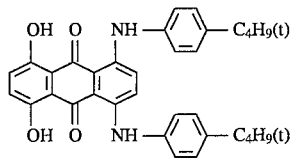

(I-24)

TABLE 1

| Sample | Support Support described in the Text or Blend (wt/wt %) | Tg (°C.) | Pre-Heat Treatment Temperature (°C.) | Pre-Heat Treatment Time (min.) | Post-Heat Treatment |
|---|---|---|---|---|---|
| 1 | Compound P-1 | 119 | 150 | 5 | gradually cooled from 140° C. to 110° C. at −1° C./min. and then gradually cooled from 110° C. to 90° C. at −1° C./hr. |
| 2 | " | " | " | " | gradually cooled from 140° C. to 110° C. at −1° C./min. and then gradually cooled from 110° C. to 90° C. at −1° C./hr. |
| 3 | " | " | " | " | gradually cooled from 140° C. to 110° C. at −1° C./min. and then gradually cooled from 110° C. to 90° C. at −1° C./hr. |
| 4 | " | " | " | " | gradually cooled from 140° C. to 110° C. at −1° C./min. and then gradually cooled from 110° C. to 90° C. at −1° C./hr. |
| 5 | " | " | " | " | gradually cooled from 140° C. to 110° C. at −1° C./min. and then gradually cooled from 110° C. to 90° C. at −1° C./hr. |
| 6 | " | " | " | " | gradually cooled from 140° C. to 110° C. at −1° C./min. and then gradually cooled from 110° C. to 90° C. at −1° C./hr. |
| 7 | " | " | " | " | gradually cooled from 140° C. to 110° C. at −1° C./min. and then gradually cooled from 110° C. to 90° C. at −1° C./hr. |
| 8 | " | " | " | " | gradually cooled from 140° C. to 110° C. at −1° C./min. and then gradually cooled from 110° C. to 90° C. at −1° C./hr. |
| 9 | " | " | " | " | gradually cooled from 140° C. to 110° C. at −1° C./min. and then gradually cooled from 110° C. |

TABLE 1-continued

| Sample | Support Support described in the Text or Blend (wt/wt %) | Tg (°C.) | Pre-Heat Treatment Temperature (°C.) | Pre-Heat Treatment Time (min.) | Post-Heat Treatment |
|---|---|---|---|---|---|
| | | | | | to 90° C. at −1° C./hr. |
| 10 | " | " | " | " | gradually cooled from 140° C. to 110° C. at −1° C./min. and then gradually cooled from 110° C. to 90° C. at −1° C./hr. |
| 11 | " | " | " | " | gradually cooled from 140° C. to 110° C. at −1° C./min. and then gradually cooled from 110° C. to 90° C. at −1° C./hr. |
| 12 | " | " | " | " | gradually cooled from 140° C. to 110° C. at −1° C./min. and then gradually cooled from 110° C. to 90° C. at −1° C./hr. |
| 13 | Compound P-15 | 104 | 135 | " | gradually cooled from 125° C. to 90° C. at −1° C./min. and gradually cooled from 90° C. to 80° C. at −1° C./hr. |
| 14 | PEN/PET = 25/75 | 83 | 120 | " | gradually cooled from 110° C. to 75° C. at −1° C./min. and gradually cooled from 75° C. to |
| 15 | PEN/PET = 0/100 | 69 | 110 | " | gradually cooled from 100° C. to 60° C. at −1° C./min. and gradually cooled from 60° C. to |
| 16 | Compound P-16 | 142 | 175 | " | gradually cooled from 165° C. to 135° C. at −1° C./min. and gradually cooled from 135° C. to 125° C. at −1° C./hr. |
| 17 | Compound P-17 | 118 | 155 | | gradually cooled from 140° C. to 110° C. at −1° C./min. and gradually cooled from 110° C. to 100° C. at −1° C./hr. |

TABLE 2

| Sample | $Ca^{++}$ Content in Gelatin for Undercoat layer (ppm) | Kind of Acid | pKa in water (°C.) | Nonionic Surface Active Agent Kind | Nonionic Surface Active Agent X | Time to Ascent of Pressure in Ultra-filtration of Undercoating solution (day) |
|---|---|---|---|---|---|---|
| 1 | 3,000 | salicylic acid | 3.00 | I-13 | 3.0 | 0.1 |
| 2 | 3,000 | hydrochloric acid | −7.0 | I-13 | 3.0 | 0.1 |
| 3 | 2,000 | salicylic acid | 3.00 | I-13 | 1.0 | 6.0 |
| 4 | 2,000 | salicylic acid | 3.00 | — | — | 3.0 |
| 5 | 2,000 | acetic acid | 4.76 | I-13 | 1.0 | 1.0 |
| 6 | 500 | salicylic acid | 3.00 | — | — | 6.0 |
| 7 | 500 | phosphoric acid | 2.15 | I-13 | 1.0 | 10.0 or more |
| 8 | 100 | fumaric acid | 3.76 | I-13 | 1.0 | 10.0 or more |
| 9 | 100 | salicylic acid | 3.00 | I-13 | 1.0 | 10.0 or more |
| 10 | 100 | salicylic acid | 1.92 | — | — | 8.0 |
| 11 | 100 | oxalic acid | 1.27 | II-1 | 1.0 | 10.0 or more |
| 12 | 100 | hydrochloric acid | −7.0 | III-2 | 1.0 | 10.0 or more |
| 13 | 100 | sulfuric acid | 3.00 | I-13 | 1.0 | 10.0 or more |
| 14 | 100 | salicylic acid | 3.00 | I-13 | 1.0 | 10.0 or more |
| 15 | 100 | salicylic acid | 3.00 | I-13 | 1.0 | 10.0 or more |
| 16 | 100 | salicylic acid | 3.00 | I-13 | 1.0 | 10.0 or more |
| 17 | 100 | salicylic acid | 3.00 | I-13 | 1.0 | 10.0 or more |

2) Surface treatment of support

Both surfaces of each of the supports were subjected to glow discharge treatment as described below. Four long cylindrical electrodes having a sectional diameter of 2 cm and a length of 40 cm were fixed to an insulating plate at a distance of 10 cm. This electrode board was fixed in a vacuum tank and the biaxially stretched film of 90 μm in thickness and 30 cm in width was run while facing toward the electrode surface at a distance of 15 cm apart from the electrode surface to effect surface treatment for 2 seconds. A heat roller having a diameter of 50 cm and equipped with a heat controller was provided so that the film came into contact with ¾ circuit of the heat roller immediately before the film passed through the electrodes and further, the surface temperature of film was controlled to be 115° C. by bringing a thermocouple thermometer into contact with the film surface between the heat roller and the electrode zone.

The pressure in the vacuum tank was 0.2 Torr and the $H_2O$ partial pressure in the atmospheric gas was 75%. The discharge frequency was 30 KHz, the output was 2,500 W and the treatment strength was 0.5 KV.A-min/$m^2$. The vacuum glow discharge electrode was the same as used in the method described in Japanese Patent Application No. 5-147864. After the discharge treatment, the support was taken up while bringing into contact with a cooling roller having a diameter of 50 cm and equipped with a heat controller to have a surface temperature before taking up of 30° C.

3-1) Coating of back first layer

A back layer formulation having the following composition was coated on the supports in an amount of 5 ml/m$^2$ by a wire bar and dried at 115° C. for 2 minutes and the support was taken up.

| | |
|---|---|
| Gelatin (lime-processed gelatin containing $Ca^{++}$as shown in Table 1) | 3.0 parts by weight |
| Water | 51.0 parts by weight |
| Methanol | 945.0 parts by weight |
| Acetic acid | 1.0 part by weight |
| Polyamide-epihalohydrin resin described in Synthesis Example 1 of JP-A-51-3619 | 0.15 part by weight |
| Nonionic surface active agent (nonionic surface active agent shown in Table 1) | X part by weight |

3-2) Back second layer

230 Parts by weight of stannic chloride hydrate and 23 parts of antimony trichloride were dissolved in 3,000 parts by weight of ethanol to obtain a uniform solution. To the resulting solution, an aqueous solution of 1N sodium hydroxide was added dropwise until the pH of the above-described solution reached 3 to obtain a coprecipitate of colloidal stannic oxide and antimony oxide. The resulting coprecipitate was allowed to stand at 50° C. for 24 hours and then a reddish brown colloidal precipitate was obtained.

The reddish brown colloidal precipitate was separated by centrifugation and water was added to the precipitate to effect water washing by centrifugation so as to remove excess ions. This procedure was repeated three times and excess ions were removed.

200 Parts by weight of colloidal precipitate from which excess ions were removed were redispersed in 1,500 parts by weight of water and atomized in a calcining furnace heated at 500° C. to obtain bluish fine particles of a composite of stannic oxide and antimony oxide having an average particle size of 0.005 μm. The resulting fine particle powder had a resistivity of 25 Ω.cm.

A mixed solution of 40 parts by weight of the above-described fine powder and 60 parts by weight of water was adjusted to have a pH of 7.0, rudely dispersed by a stirrer and then dispersed in a horizontal sand mill (Dynomill, manufactured by Willy A. Backfen AG) until the residence time reached 30 minutes to produce a dispersion solution in which primary particles partly aggregated to form a secondary aggregate having a size of 0.05 μm.

A solution having the following formulation was coated on each of the supports to give a dry thickness of 0.3 μm and then dried at 110° C. for 30 seconds.

| | |
|---|---|
| Electrically conductive fine particle dispersion prepared above ($SnO_2/Sb_2O_3$, 0.15 μm) | 100 parts by weight |
| Gelatin (lime-processed gelatin containing 100 ppm of $Ca^{++}$) | 10 parts by weight |
| Water | 270 parts by weight |
| Methanol | 600 parts by weight |
| Resorcine | 20 parts by weight |
| Nonionic surfactant (Compound I-13) | 0.1 part by weight |

The support on which the back first layer and the back second layer were coated was subjected to pre-heat treatment and post-heat treatment, where the heat treatments were conducted on the support with the core of 30 cm in diameter while facing the undercoated surface outward in all cases.

3-3) Coating of undercoat layer (on emulsion layer side)

An undercoating solution having the following composition was coated on the supports which had been subjected to pre-heat treatment and post-heat treatment, on the side opposite to that applied by the back first layer, in an amount of 10 ml/m$^2$ by a wire bar and dried at 115° C. for 2 minutes and the support was taken up.

| | |
|---|---|
| Gelatin (lime-processed gelatin containing $Ca^{++}$ as shown in Table 1) | 10.0 parts by weight |
| Water | 24.0 parts by weight |
| Methanol | 961.0 parts by weight |
| Salicylic acid | 3.0 parts by weight |
| Polyamide-epihalohydrin described in Synthesis Example 1 of JP-A-51-3619 | 0.5 part by weight |
| Nonionic surface active agent (nonionic surface active agent shown in Table 1) | X part by weight |

Samples 1 and 2 are comparative samples and Samples 3 to 17 are samples of the present invention.

3-4) Back third layer

A solution having the following formulation was coated on the supports to have a dry thickness of 1.2 μm and dried at 110° C.

| | |
|---|---|
| Diacetyl cellulose | 100 parts by weight |
| Trimethylolpropane-3-toluene diisocyanate | 25 parts by weight |
| Methyl ethyl ketone | 1050 parts by weight |
| Cyclohexanone | 1050 parts by weight |

3-5) Coating of back fourth layer

Preparation of slide layer

The following first solution was dissolved under heating at 90° C. and after adding to the second solution, the mixture was dispersed in a high-pressure homogenizer to provide a dispersion crude solution for the slide layer.

First solution

| | |
|---|---|
| Compound $C_6H_{13}CH(OH)(CH_2)_{10}COOC_{40}H_{61}$ | 0.7 g |
| Compound n-$C_{50}H_{101}O(CH_2CH_2O)_{16}H$ | 1.1 g |
| Xylene | 2.5 g |

Second Solution

| | |
|---|---|
| Propylene glycol monomethyl ether | 34.0 g |

To the dispersion crude solution obtained above, the following binder and solvents were added to provide a coating solution.

| | |
|---|---|
| Diacetyl cellulose | 3.0 g |
| Acetone | 600.0 g |
| Cyclohexanone | 350.0 g |

The coating solution for the slide layer was coated in an amount of 10 ml/m$^2$ by a wire bar.

4) Preparation of photographic material

A multi-layered color photographic material as a sample was prepared by coating layers each having the following composition in a superposed fashion on each support having an undercoat layer.

Composition of light-sensitive layer

Main materials used in each layer are classified as follows:

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective ingredients show coating amounts expressed by the unit g/m$^2$ and in case of silver halide, they show coating amounts in terms of silver. With respect to sensitizing dyes, the coating amount is shown by the unit mole per mole of silver halide in the same layer.

| First Layer (antihalation layer) | | |
|---|---|---|
| Black colloidal silver | as silver | 0.09 |
| Gelatin | | 1.60 |
| ExM-1 | | 0.12 |
| ExF-1 | | $2.0 \times 10^{-3}$ |
| Solid disperse dye ExF-2 | | 0.030 |
| Solid disperse dye ExF-3 | | 0.040 |
| HBS-1 | | 0.15 |
| HBS-2 | | 0.02 |

| Second Layer (interlayer) | | |
|---|---|---|
| Silver iodobromide emulsion M | as silver | 0.065 |
| ExC-2 | | 0.04 |
| Polyethylacrylate latex | | 0.20 |
| Gelatin | | 1.04 |

| Third Layer (low-speed red-sensitive emulsion layer) | | |
|---|---|---|
| Silver iodobromide emulsion A | as silver | 0.25 |
| Silver iodobromide emulsion B | as silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |

| Fourth Layer (medium-speed red-sensitive emulsion layer) | | |
|---|---|---|
| Silver iodobromide emulsion C | as silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |

-continued

| Fifth Layer (high-speed red-sensitive emulsion layer) | | |
|---|---|---|
| Silver iodobromide emulsion D | as silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |

| Sixth Layer (interlayer) | | |
|---|---|---|
| Cpd-1 | | 0.090 |
| Solid dispersed dye ExF-4 | | 0.030 |
| HBS-1 | | 0.050 |
| Polyethylacrylate latex | | 0.15 |
| Gelatin | | 1.10 |

| Seventh Layer (low-speed green-sensitive emulsion layer) | | |
|---|---|---|
| Silver iodobromide emulsion E | as silver | 0.15 |
| Silver iodobromide emulsion F | as silver | 0.10 |
| Silver iodobromide emulsion G | as silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |

| Eighth Layer (medium-speed green-sensitive emulsion layer) | | |
|---|---|---|
| Silver iodobromide emulsion H | as silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |

| Ninth Layer (high-speed green-sensitive emulsion layer) | | |
|---|---|---|
| Silver iodobromide emulsion I | as silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |

| Tenth Layer (yellow filter layer) | | |
|---|---|---|
| Yellow colloidal silver | as silver | 0.015 |
| Cpd-1 | | 0.16 |
| Solid disperse dye ExF-5 | | 0.060 |
| Solid disperse dye ExF-6 | | 0.060 |
| Oil-soluble dye ExF-7 | | 0.010 |
| HBS-1 | | 0.60 |

-continued

| | | |
|---|---|---|
| Gelatin | | 0.60 |
| Eleventh Layer (low-speed blue-sensitive emulsion layer) | | |
| Silver iodobromide emulsion J | as silver | 0.09 |
| Silver iodobromide emulsion K | as silver | 0.09 |

-continued

| | | |
|---|---|---|
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| Twelfth Layer (high-speed blue-sensitive emulsion layer) | | |
| Silver iodobromide emulsion L | as silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| Thirteenth Layer (first protective layer) | | |
| UV-1 | | 0.19 |
| UV-2 | | 0.075 |
| UV-3 | | 0.065 |
| ExF-8 | | 0.045 |
| ExF-9 | | 0.050 |
| HBS-1 | | $5.0 \times 10^{-2}$ |
| HBS-4 | | $5.0 \times 10^{-2}$ |
| Gelatin | | 1.8 |
| Fourteenth Layer (second protective layer) | | |
| Silver iodobromide emulsion M | as silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| Gelatin | | 0.70 |

Further, in order to provide good preservability, processability, pressure resistance, antimold/fungicidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead slat, gold salt, platinum salt, palladium salt, iridium salt or rhodium salt was appropriately added to each layer.

TABLE 3

| | Average AgI Content (%) | Coefficient of Fluctuation in AgI Content of Grains (%) | Sphere-corresponding Mean Grain Size (μm) | Coefficient of Fluctuation in Grain Size (%) | Circle-corresponding Projected Area Diameter (μm) | Diameter/ Thickness Ratio |
|---|---|---|---|---|---|---|
| Emulsion A | 1.7 | 10 | 0.46 | 15 | 0.56 | 5.5 |
| Emulsion B | 3.5 | 15 | 0.57 | 20 | 0.78 | 4.0 |
| Emulsion C | 8.9 | 25 | 0.66 | 25 | 0.87 | 5.8 |
| Emulsion D | 8.9 | 18 | 0.84 | 26 | 1.03 | 3.7 |
| Emulsion E | 1.7 | 10 | 0.46 | 15 | 0.56 | 5.5 |
| Emulsion F | 3.5 | 15 | 0.57 | 20 | 0.78 | 4.0 |
| Emulsion G | 8.8 | 25 | 0.61 | 23 | 0.77 | 4.4 |
| Emulsion H | 8.8 | 25 | 0.61 | 23 | 0.77 | 4.4 |
| Emulsion I | 8.9 | 18 | 0.84 | 26 | 1.03 | 3.7 |
| Emulsion J | 1.7 | 10 | 0.46 | 15 | 0.50 | 4.2 |
| Emulsion K | 8.8 | 18 | 0.64 | 23 | 0.85 | 5.2 |
| Emulsion L | 14.0 | 25 | 1.28 | 26 | 1.46 | 3.5 |
| Emulsion M | 1.0 | — | 0.07 | 15 | — | 1 |

In Table 3:

(1) Emulsions J to L were subjected to reduction sensitization at the grain preparation using thiourea dioxide and thiosulfonic acid according to the example of JP-A-2-191938;

(2) Emulsions A to I were subjected to gold sensitization, sulfur sensitization and selenium sensitization in the presence of the spectral sensitizing dyes described in each light-sensitive layer and sodium thiocyanate according to the example of JP-A-3-237450;

(3) in the preparation of tabular grains, low molecular weight gelatin was used according to the example of JP-A-1-158426;

(4) in tabular grains, dislocation lines were observed through a high-pressure electron microscope as described in JP-A-3-237450; and (5) Emulsion L is a double structured grain having an internal high iodide core described in JP-A-60-143331.

Preparation of dispersion of organic solid disperse dye

ExF-2 shown below was dispersed in the following manner. Namely, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were poured in a 700 ml-volume pot mill, then thereto 5.0 g of Dye ExF-2 and 500 ml of zirconium oxide beads (diameter 1 mm) were added and the mixture was dispersed for 2 hours. The dispersion was conducted using a BO-type vibrating ball mill produced by Chuo Koki K.K. After the dispersion, the content was taken out and thereto 8 g of a 12.5% aqueous gelatin solution was added and beads were removed by filtration to obtain a gelatin dispersion of the dye. The fine dye particles had a mean particle diameter of 0.44 μm.

In the same manner, solid dispersions of ExF-3, ExF-4 and ExF-6 were obtained. The fine dye particles had a mean particle diameter of 0.24 μm, 0.45 μm and 0.52 μm, respectively. ExF-5 was dispersed by the microprecipitation dispersion method described in Example 1 of European Patent Application (EP) No. 549,489A and the mean particle diameter thereof was 0.06 μm.
ExC-1
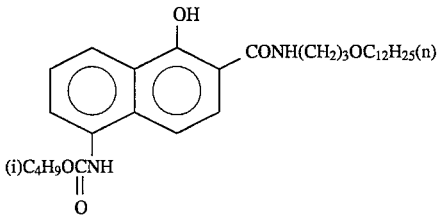
ExC-2
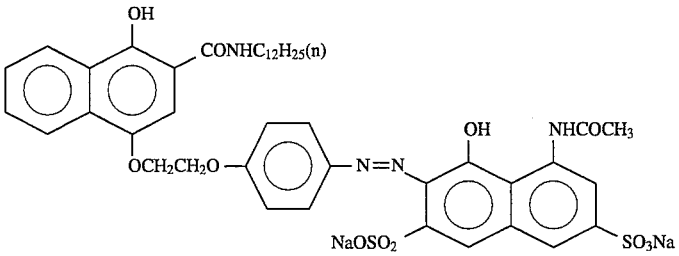
ExC-3
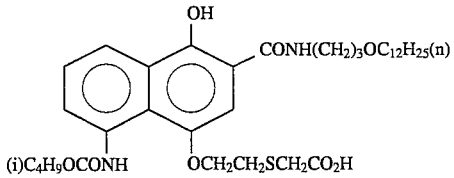
ExC-4
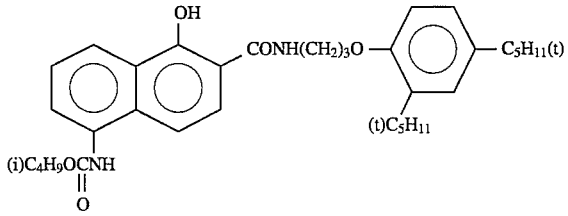
ExC-5
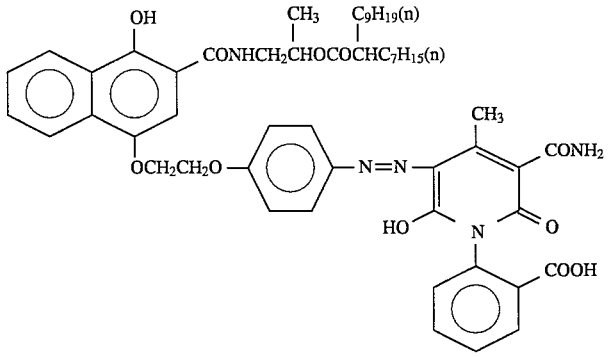

-continued
ExC-6
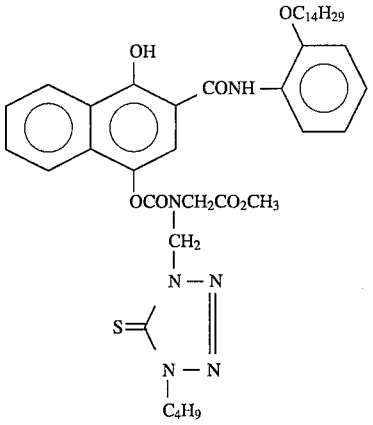
ExC-7
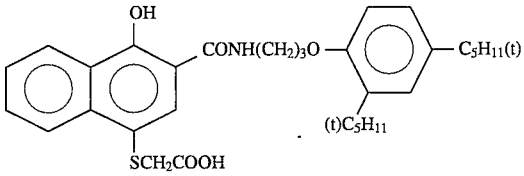
ExC-8
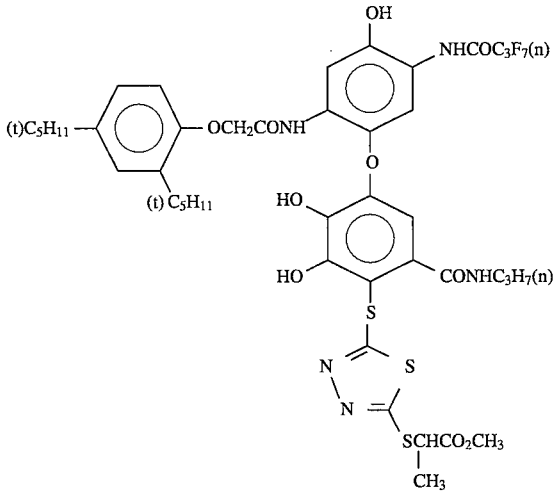
ExM-1
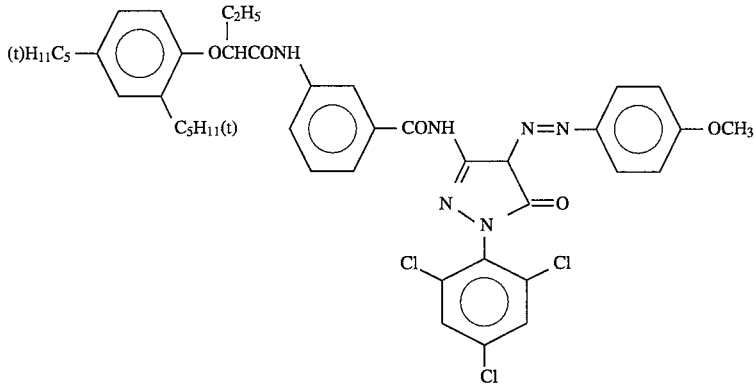

-continued
ExM-2
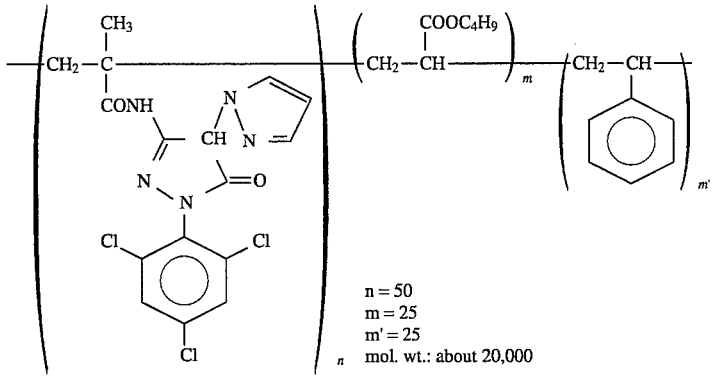
ExM-3
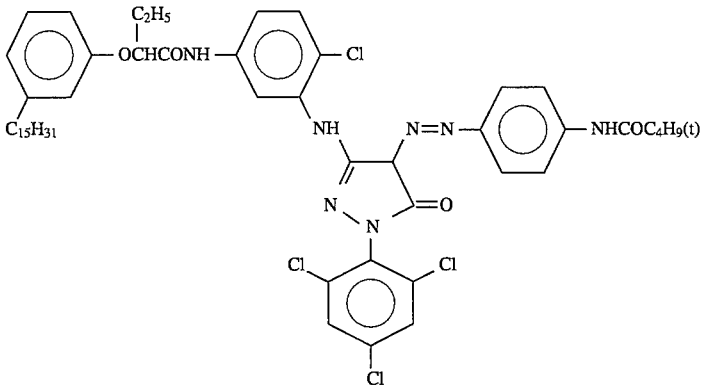
ExM-4
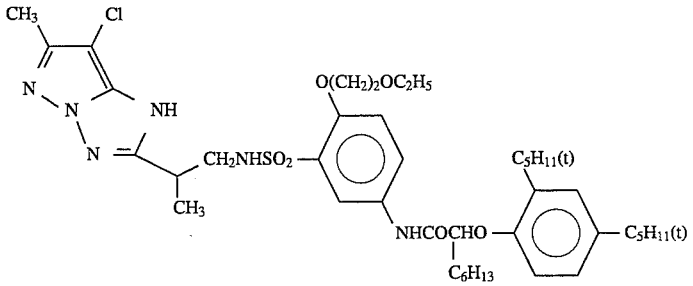
ExM-5
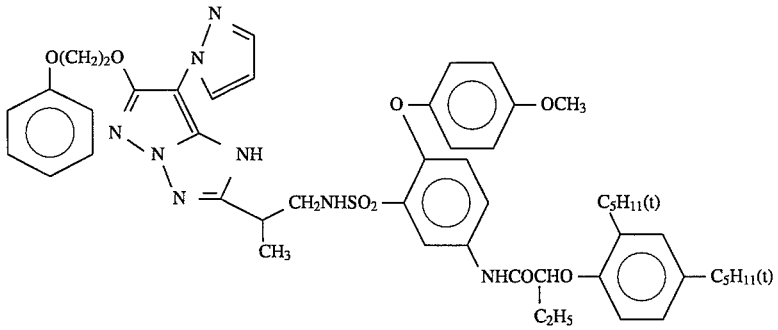

-continued
ExY-1
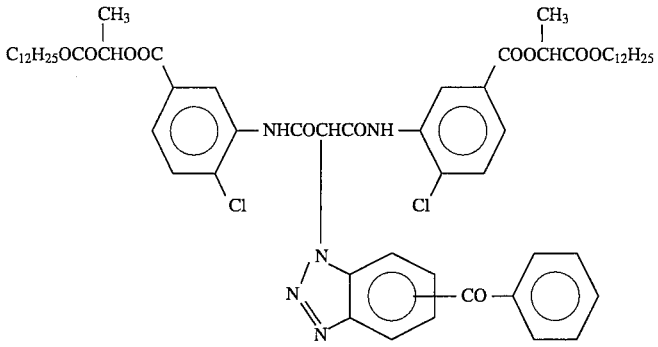
ExY-2
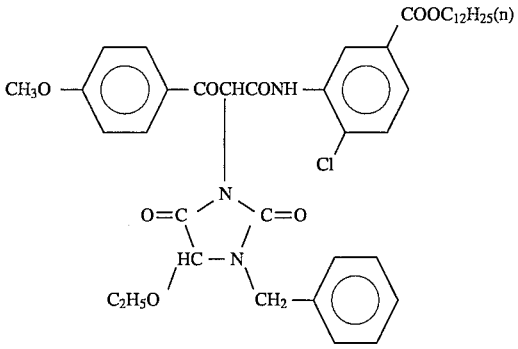
ExY-3
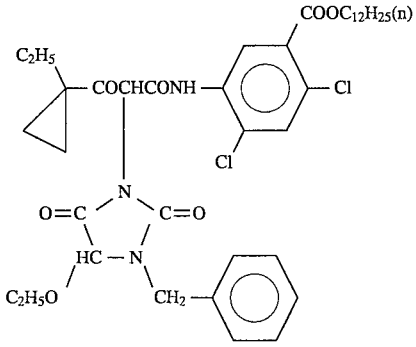
ExY-4
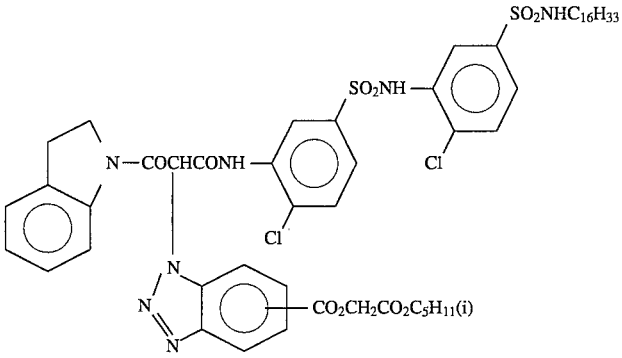

-continued
ExY-5
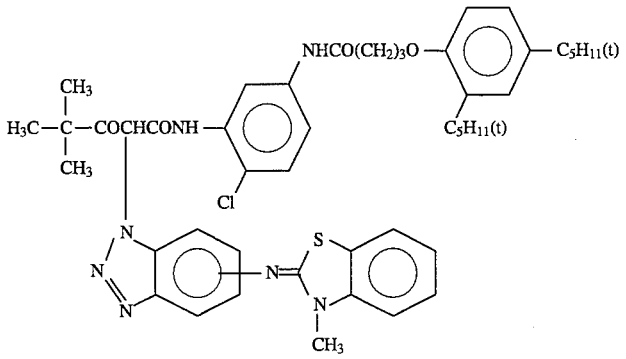
ExF-1
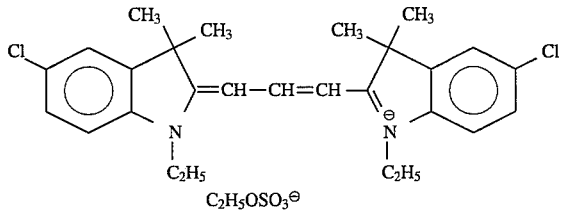
ExF-2
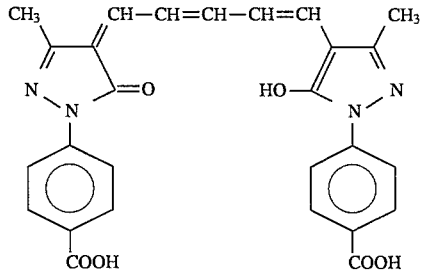
ExF-3
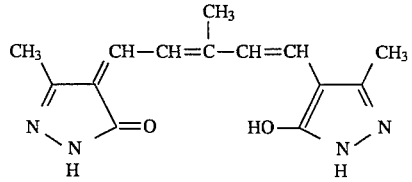
ExF-4
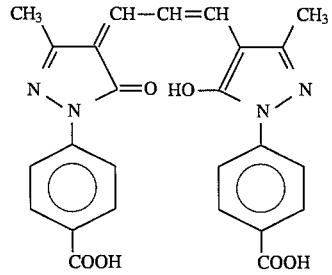

-continued
ExF-5
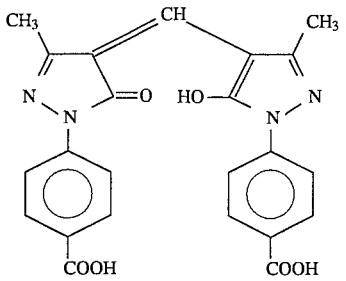
ExF-6
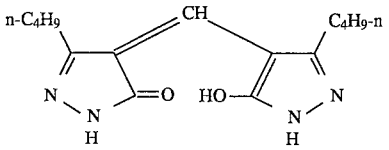
ExF-7
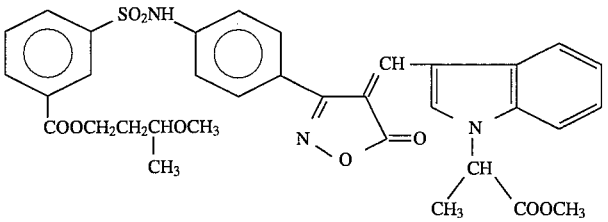
ExF-8
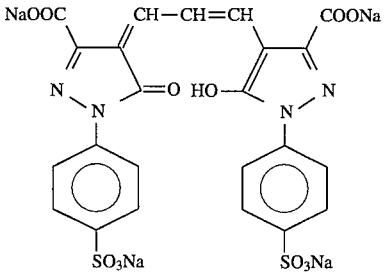
ExF-9
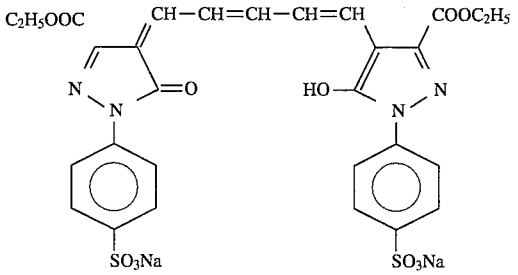
Cpd-1

-continued
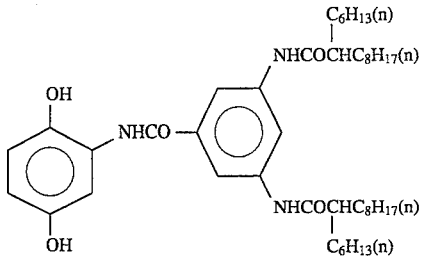
Cpd-2
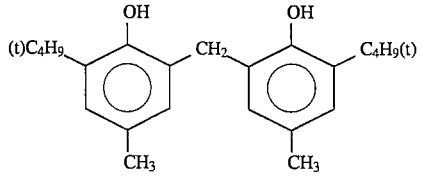
Cpd-3
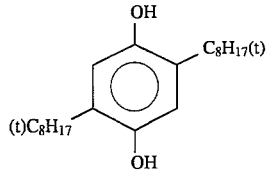
UV-1
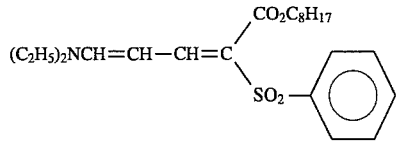
UV-2
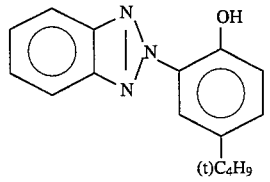
UV-3
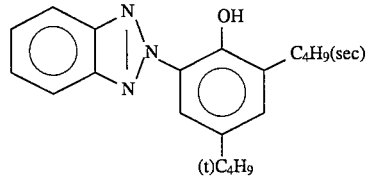
HBS-1
Tricresyl phosphate
HBS-2
Di-n-butyl phthalate
HBS-3
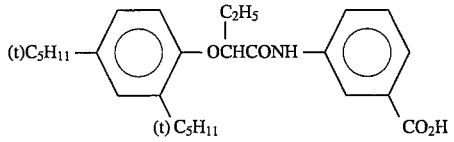
HBS-4
Tri(2-ethylhexyl) phosphate -continued
ExS-1
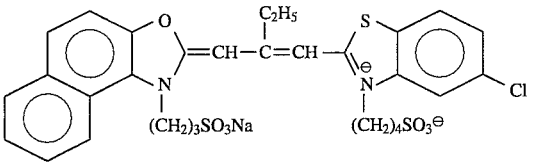
ExS-2
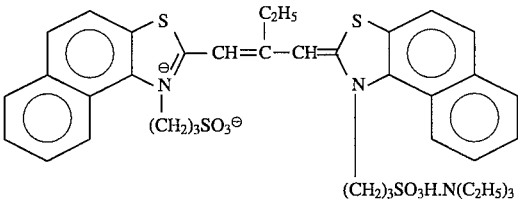
ExS-3
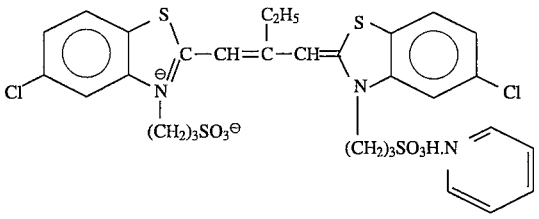
ExS-4
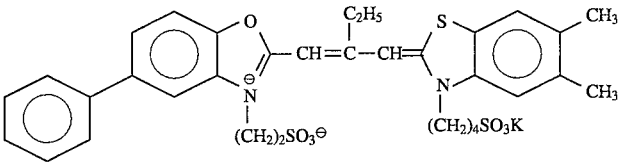
ExS-5
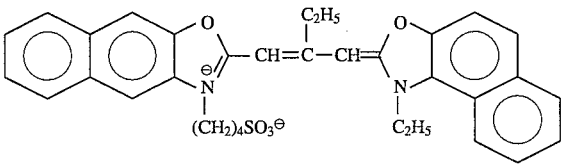
ExS-6
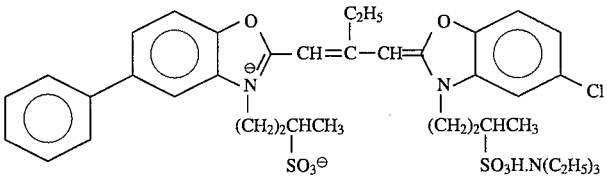
ExS-7
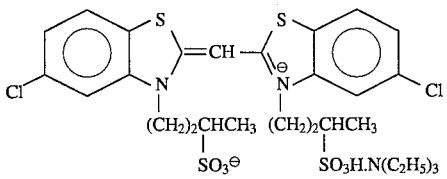
S-1

-continued
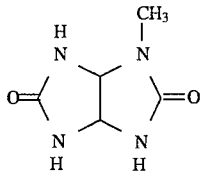
H-1
$CH_2{=}CH{-}SO_2{-}CH_2{-}CONH{-}CH_2$
$CH_2{=}CH{-}SO_2{-}CH_2{-}CONH{-}CH_2$
B-1
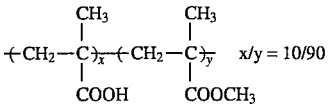
x/y = 10/90
B-2
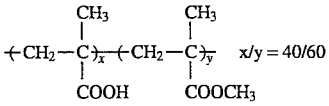
x/y = 40/60
B-3
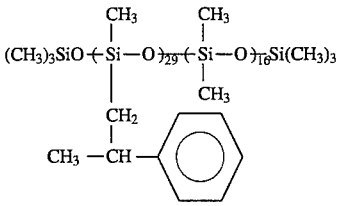
B-4
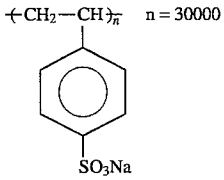
n = 30000
B-5
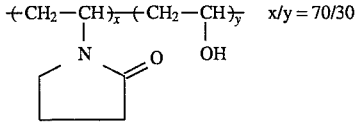
x/y = 70/30
B-6
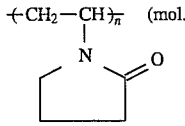
(mol. wt.: about 10,000)
W-1
$C_8F_{17}SO_2NHCH_2CH_2CH_2OCH_2CH_2\overset{\oplus}{N}(CH_3)_3$
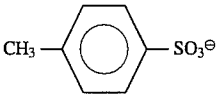

-continued
W-2
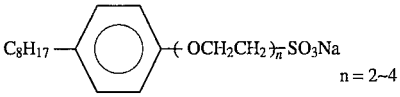
W-3
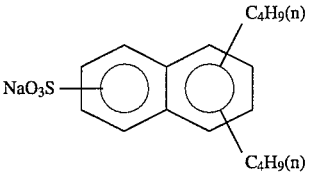
F-1
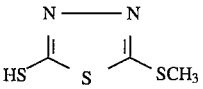
F-2
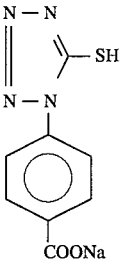
F-3
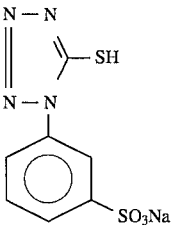
F-4
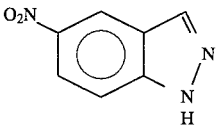
F-5
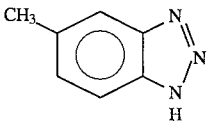
F-6
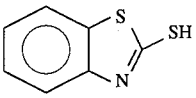

-continued
F-7
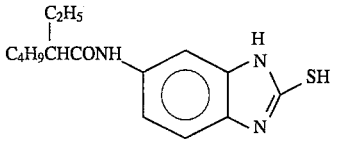
F-8
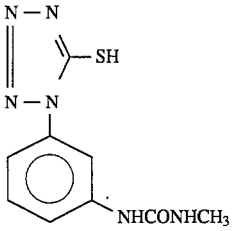
F-9
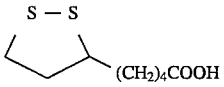
F-10
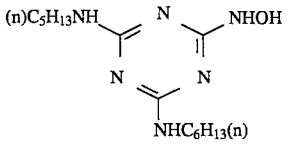
F-11
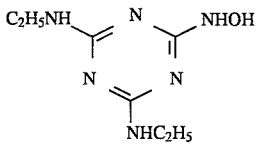
F-12
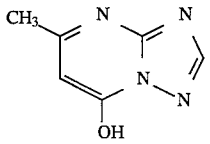
F-13
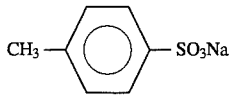
F-14
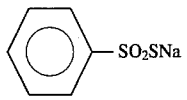
F-15

-continued

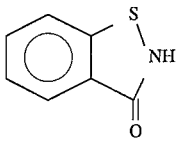

F-16

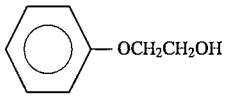

F-17

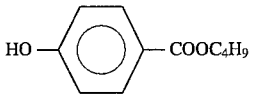

5) Evaluation on time to ascent of pressure in filtration of undercoating solution for emulsion layer The undercoating solution for the emulsion layer prepared was filtered using a filter CP-1 (average bore diameter: 1 μm) and the time for the filtration pressure to rise to 1 kg/cm$^2$ was determined. In view of industrial productivity, the filtration pressure must be kept to less than 1 kg/cm$^2$ for one or more day.

6) Evaluation on photographic film

The curling habit of each photographic sample was evaluated according to the following procedure.

6-1) Core set

The film formed was cut into a slit of 35 mm in width and 1.2 m in length. After leaving the film to stand at 25° C. and 60% RH one night to adjust the moisture, the film was wound round a spool having a thickness of 7 mm in a cartridge having an inner diameter of 15.5mm while facing the light-sensitive layers inwardly. The film was placed in a closed container and heated at 80° C. for 2 hours to have a curling habit. This was the condition set by imaging a film left in an automobile in summer season.

6-2) Evaluation on folding at film end edge after development and on unevenness in development The film having a curling habit imposed under the above-described condition was released to cool at 25° C. and then the sample film was taken out from the closed container and developed in an automatic developing machine (Mini-Lab FP-550B using the processing solution CN-16Q, manufactured by Fuji Photo Film Co., Ltd.). The film was processed with a processing solution used in a running processing of a film which had been previously imagewise exposed, separately conducted until the replenishing amount of the color developer reached 3 times the tank volume.

After the processing, the film was visually observed and found that the film was free of folding at the end edge and also of uneven development and was good.

7) Results

The results are shown in Table 2. In samples 3 to 17 according to the present invention, in which gelatin having a calcium ion ($Ca^{++}$) content of 2,500 ppm or less based on the dry gelatin was used in the undercoat layer, the generation of aggregates was reduced and the time to the ascent of ultra-filtration pressure was long. In samples 3 and 4, in which the gelatin having a calcium ion ($Ca^{++}$) content of 2,500 ppm or less was swelled by a solution obtained by previously mixing an acid having a pKa in water of from −8.0 to 4.0 with methanol, the aggregates were reduced and the time to the ascent of ultrafiltration pressure was further prolonged as compared with Sample 5. In Sample 3, in which gelatin of Sample 4 having a calcium ion ($Ca^{++}$) content of 2,500 ppm or less was used in combination with a nonionic surface active agent, the time to the ascent of ultrafiltration pressure was further prolonged.

It is seen from the foregoing that by the use of delimed gelatin as a binder for the undercoating solution of the support, the filterability of the coating solution is improved and the productivity in the coating step is remarkably increased.

EXAMPLE 2

1) Preparation of support

Pellets of compounds PEN, PET, PAr or PCT used in this Example were previously dried at 150° C. for 4 hours. In each support formed by mixing the compounds at a ratio shown in Table 4, simple pellets were first mixed at a ratio as shown in the table and then extruded at 280° C. using a biaxial knead-extruder, followed by pelletization. To these solid contents of polyester, the following Compound (I-6) and Compound (I-24) were added as dyestuffs each in an amount of 54 ppm and dried by a usual method.

Each of these pellets were molten at 300° C., extruded from a T-type die, longitudinally stretched at (Tg+30)° C. to 3.1 times, then transversely stretched at (Tg+20)° C. to 3.5 times and subjected to heat fixing at 250° C. for 6 seconds to form a biaxially stretched polyester support having a thickness of 90 μm.

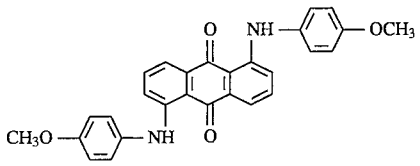

Compound (I-6)

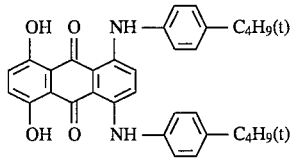

Compound (I-24)

TABLE 4

| Sample | Support Support described in the Text or Blend (wt/wt %) | Tg (°C.) | Pre-Heat Treatment Temperature (°C.) | Pre-Heat Treatment Time (min.) | Post-Heat Treatment |
|---|---|---|---|---|---|
| 1 | Compound P-1 | 119 | 150 | 5 | gradually cooled from 140° C. to 110° C. at −1° C./min. and then gradually cooled from 110° C. to 90° C. at −1° C./hr. |
| 2 | " | " | " | " | gradually cooled from 140° C. to 110° C. at −1° C./min. and then gradually cooled from 110° C. to 90° C. at −1° C./hr. |
| 3 | " | " | " | " | gradually cooled from 140° C. to 110° C. at −1° C./min. and then gradually cooled from 110° C. to 90° C. at −1° C./hr. |
| 4 | " | " | " | " | gradually cooled from 140° C. to 110° C. at −1° C./min. and then gradually cooled from 110° C. to 90° C. at −1° C./hr. |
| 5 | " | " | " | " | gradually cooled from 140° C. to 110° C. at −1° C./min. and then gradually cooled from 110° C. to 90° C. at −1° C./hr. |
| 6 | " | " | " | " | gradually cooled from 140° C. to 110° C. at −1° C./min. and then gradually cooled from 110° C. to 90° C. at −1° C./hr. |
| 7 | " | " | " | " | gradually cooled from 140° C. to 110° C. at −1° C./min. and then gradually cooled from 110° C. to 90° C. at −1° C./hr. |
| 8 | " | " | " | " | gradually cooled from 140° C. to 110° C. at −1° C./min. and then gradually cooled from 110° C. to 90° C. at −1° C./hr. |
| 9 | " | " | " | " | gradually cooled from 140° C. to 110° C. at −1° C./min. and then gradually cooled from 110° C. to 90° C. at −1° C./hr. |
| 10 | Compound P-15 PEN/PET = 80/20 | 104 | 135 | " | gradually cooled from 125° C. to 90° C. at −1° C./min. and gradually cooled from 90° C. to 80° C. at −1° C./hr. |
| 11 | Compound P-14 PEN/PET = 60/40 | 95 | 125 | " | gradually cooled from 145° C. to 90° C. at −1° C./min. and gradually cooled from 90° C. to 70° C. at −1° C./hr. |
| 12 | PEN/PET = 0/100 | 69 | 110 | " | gradually cooled from 100° C. to 60° C. at −1° C./min. and gradually cooled from 60° C. to 50° C. at −1° C./hr. |
| 13 | Compound P-17 | 118 | 155 | " | gradually cooled from 140° C. to 110° C. at −1° C./min. and gradually cooled from 110° C. to 100° C. at −1° C./hr. |

TABLE 5

| Sample | Surface Treatment G or UV | Polyamide-epihalohydrin Resin Compound | Volume Resistance (Ωcm, $10^{-x}$) | Adhesive Property In Dry Condition | Adhesive Property In Wet Condition | AS Static Mark | AS Attachment of Dusts | Remarks |
|---|---|---|---|---|---|---|---|---|
| 1 | — | PH-1 | 8 | D | D | A | A | Comparison |
| 2 | — | PH-2 | 8 | D | D | A | A | Comparison |
| 3 | G | not added | 8 | C | D | A | A | Comparison |
| 4 | G | PH-1 | 8 | A | C | A | A | Invention |
| 5 | G | PH-3 | 8 | A | A | A | A | Invention |
| 6 | UV | not added | 8 | D | D | A | A | Comparison |
| 7 | UV | PH-5 | 8 | A | A | A | A | Invention |
| 8 | G | PH-6 | 14 | A | A | C | C | Invention |
| 9 | G | PH-18 | 11 | A | A | B | B | Invention |
| 10 | G | PH-3 | 8 | A | A | A | A | Invention |
| 11 | G | PH-3 | 8 | A | A | A | A | Invention |
| 12 | G | PH-6 | 8 | A | A | A | A | Invention |
| 13 | G | PH-2 | 8 | A | A | A | A | Invention |

2) Surface treatment of support

Both surfaces of each support were subjected to glow discharge treatment (shown as G in the above Table) or ultraviolet ray irradiation treatment (shown as UV in the above Table) as described below.

Four long cylindrical electrodes having a sectional diameter of 2 cm and a length of 40 cm were fixed to an insulating plate at a distance of 10 cm. This electrode board was fixed in a vacuum tank and the biaxially stretched film of 90 μm in thickness and 30 cm in width was run while facing toward the electrode surface at a distance of 15 cm apart from the electrode surface to effect surface treatment for 2 seconds. A heat roller having a diameter of 50 cm and equipped with a heat controller was provided so that the film came into contact with ¾ circuit of the heat roller immediately before the film passed through the electrodes and further, the surface temperature of film was controlled to be 115° C. by bringing a thermocouple thermometer into contact with the film surface between the heat roller and the electrode zone.

The pressure in the vacuum tank was 0.15 Torr and the $H_2O$ partial pressure in the atmospheric gas was 80%. The discharge frequency was 30 KHz, the output was 2,500 W and the treatment strength was 0.5 KV.A-min/$m^2$. After the discharge treatment, the support was wound up while bringing it into contact with a cooling roller having a diameter of 50 cm and equipped with a heat controller to have a surface temperature before taking up of 30° C.

The ultraviolet rays were irradiated on both surfaces of the support using a 1 KW cylindrical high-pressure mercury lamp, which was made of quartz, had a width of 50 cm, an arc length of 30 cm and a main wavelength at 365 nm, and lay in parallel with and at a distance of 10 cm from the film surface, for 2 minutes in an air at 115° C. The quantity of light irradiated was 500 mJ/$cm^2$.

3-1) Coating of undercoat layer (on emulsion layer side)

A methanol-based undercoating solution having the following composition was coated on each support in an amount of 10 ml/$m^2$ by a wire bar and dried at 115° C. for 2 minutes and the support was wound up.

First, the following gelatin was mixed with water and swelled at a normal temperature for 30 minutes.

| | |
|---|---|
| Gelatin ($Ca^{++}$ content: 100 ppm) | 10.0 parts by weight |
| Water | 24.0 parts by weight |

The following mixed solution of salicylic acid and methanol was added and the gelatin was further swelled at a normal temperature for 30 minutes.

| | |
|---|---|
| Salicylic acid | 3.0 parts by weight |
| Methanol | 78.0 parts by weight |

After dissolving the swelled gelatin under heating at 50° C., the following methanol was added thereto while stirring the solution, the gelatin was dispersed therein and the dispersion was cooled to room temperature.

| | |
|---|---|
| Methanol | 884.0 parts by weight |

Then, the following surface active agent was added and at the final stage, the following polyamide-epihalohydrin resin was added.

| | |
|---|---|
| Nonionic surface active agent, Compound I-13, described in JP-B-3-27099 | 1.0 part by weight |
| Polyamide-epihalohydrin resin | 3.0 parts by weight |

For the purpose of comparison, a solution to which the polyamide-epihalohydrin resin was not added was coated.

On the thus-provided undercoat layer, the light-sensitive layers described later were coated.

3-2) Coating of back first layer

After undercoating, a methanol-based back layer formulation having the following composition was coated on each support on the side opposite to the side provided with the undercoat layer in an amount of 5 ml/$m^2$ by a wire bar and dried at 115° C. for 2 minutes and the support was wound up.

First, the following gelatin was mixed with water and swelled at a normal temperature for 30 minutes.

| | |
|---|---|
| Gelatin ($Ca^{++}$ content: 100 ppm) | 10.0 parts by weight |
| Water | 51.0 parts by weight |
| Acetic acid | 1.0 part by weight |
| Methanol | 937.0 parts by weight |
| Nonionic surface active agent, Compound I-13, described in JP-B-3-27099 | 1.0 part by weight |
| Polyamide-epihalohydrin resin PH-3 | 3.0 parts by weight |

The back second, back third and back fourth layers were provided in the same manner as in Example 1. Thereafter, the support was subjected to pre-heat treatment and post-heat treatment. The heat treatments were conducted on the support with the core of 30 cm in diameter while facing the under-coated surface outward in all cases.

4) Preparation of photographic material

A multi-layered color photographic material as a sample was prepared by coating layers provided in Sample 103 in Example 1 of JP-A-5-323540 in a superposed fashion on support provided with a undercoat layer.

5) Evaluation on photographic film

The curling habit of each photographic sample was evaluated with respect to folding at the film end edge after development and unevenness in development using the same core set in the same manner as in Example 1.

6) Evaluation on adhesion 6-1) Evaluation on adhesion in dry condition

Six slits were made on the surface of a sample by a razor at a distance of 5 mm in length and breadth to form 25 squares and a pressure sensitive adhesive tape (Nitto-Tape, produced by Nitto Denki Kogyo K.K.) was affixed thereto and promptly peeled off at an angle of 180°. When the unpeeled area was 95% or more, the rank was class A, when the unpeeled area was 90% or more, class B, when the unpeeled area was 60% or more, class C, and when the unpeeled area was less than 60%, class D. The photographic materials having the adhesive strength ranked as class A according to the above-described four-grade classification lie on the level sufficiently durable in practical use a photographic material.

6-2) Evaluation on adhesion in wet condition

A mark x was scratched by a pencil on the emulsion surface of film in a solution during each processing step of color development, fixing or stabilization and the film was strongly rubbed five times by a finger tip capped with a rubber sack, and the adhesive force was evaluated by the maximum breadth peeled along the mark x.

When the emulsion layer was not peeled off except for the mark, the rank was class A, when the maximum peeled breadth was 2 mm or more, class B, when the maximum peeled breadth was within 5 mm, the rank was class C, and others was ranked as class D. The photographic materials having the strength ranked as class A according to the above-described four-grade classification lie on the level sufficiently durable in practical use as a photographic material.

7) Evaluation on static mark 7-1) Static mark test

After unexposed samples each was subjected to moisture conditioning at 25° C. and 10% RH for 6 hours, each sample was rubbed with rubber roller and urethane roller to examine how the static marks grew on respective materials, then processed in the above-described automatic processor and the occurrence degree of static marks was examined.

The evaluation on the occurrence of static marks was made according to the following three grades.

A: occurrence of static marks was not observed at all

B: occurrence of static marks was slightly observed

C: occurrence of static marks was seriously observed 7-2) Dust attachment test:

Samples (size: 20 cm×20 cm) before or after development each was well rubbed with nylon under conditions of a temperature of 25° C. and a humidity of 10% RH and examined on the attachment of ashes of tobacco. The evaluation was conducted according to the following three grades.

A: attachment of dusts was not observed at all

B: attachment of dusts was slightly observed

C: attachment of dusts was seriously observed

8) Results:

The results are shown in Table 5. Samples 3 and 6, to which only surface treatment was applied and the polyamide-epihalohydrin was not added, and Samples 1 and 2, to which surface treatment was not applied and only the polyamide-epihalohydrin resin was added, exhibited poor adhesive. When samples were subjected to surface treatment and comprised an undercoat layer containing a polyamide-epihalohydrin resin, those using a polyamide-epihalohydrin resin prepared according to the present invention showed good adhesive property but Sample 4 using a polyamide-epihalohydrin resin prepared according to a conventional method showed bad adhesive property.

Sample 8 free of a dispersion solution of electrically conductive fine particles was inferior in AS property and suffered from generation of static marks or attachment of dusts. By the addition of electrically conductive fine particles and with a volume resistance of $10^{11}$ Ωcm, the AS property is rather improved and with a volume resistance of $10^{8}$ Ωcm, static marks or attachment of dusts was not generated at all.

From the foregoing results, it is seen that the following effects could be achieved. Namely, by coating an undercoating solution containing a polyamide-epihalohydrin resin of the present invention on the polyester support of which surface was subjected to glow discharge treatment or ultraviolet irradiation, adhesion to the silver halide light-sensitive layers is good.

Further, the polyester support having a glass transition temperature (Tg) of from 90° to 200° C. is hard to have a curling habit and by using such a support, a silver halide photographic material having a good handleability during development or after development can be produced.

Furthermore, by providing at least one electrically conductive layer containing a metal oxide having a volume resistivity of $10^{8}$ Ωcm or less on at least one surface of the support, a silver halide photographic material having good antistatic property can be obtained.

EXAMPLE 3

1) Preparation of support

To 100 parts by weight of pellets of commercially available polymers PEN, PET, PAr or PCT or polyester copolymers for Samples 24 to 27 in Table 6, a dyestuff, Diaresin (produced by Mitsubishi Chemical Industries, Ltd.), was added to give a thickness of 80 μm and an absorbance at 400 nm of 0.05 and then the mixture was dried by a usual method, molten at 300° C., extruded from a T-type die to be longitudinally stretched at 140° C. to 3.3 times and then transversely stretched at 130° C. to 3.3 times, and subjected to heat fixing at 250° C. for 6 seconds to form films of support Samples 1 to 30 having a thickness of 55 μm, 60 μm or 90 μm as shown in Table 6.

TABLE 6

| | Support; Compositional | | | Heat Treatment | | | | |
|---|---|---|---|---|---|---|---|---|
| | | | | First Gradual Cooling; at Constant Temperature | | Second Gradual Cooling; −1° C./hr. | | |
| Sample | Ratio of Blend (PEN/PET) (wt/wt %) | Thickness (μm) | Tg (°C.) | Retention Temperature (°C.) | Retention Time (hr.) | Initial Temperature (°C.) | Final Temperature (°C.) | Remarks |
| 1 | 100/0 | 90 | 119 | — | — | — | — | Invention |
| 2 | " | " | " | 110 | 24 | 110 | 90 | Invention |
| 3 | " | " | " | " | " | " | " | Comparison |
| 4 | " | " | " | " | " | " | " | Invention |
| 5 | " | 60 | " | " | " | " | " | Invention |
| 6 | " | 55 | " | " | " | " | " | Invention |
| 7 | " | 90 | " | " | " | " | " | Invention |
| 8 | " | " | " | " | " | " | " | Invention |
| 9 | " | " | " | " | " | " | " | Comparison |
| 10 | " | " | " | " | " | " | " | Invention |
| 11 | " | " | " | " | " | " | " | Invention |
| 12 | " | " | " | " | " | " | " | Invention |
| 13 | " | " | " | " | " | " | " | Invention |
| 14 | " | " | " | " | " | " | " | Invention |
| 15 | " | " | " | " | " | " | " | Invention |
| 16 | " | " | " | " | " | " | " | Invention |
| 17 | " | " | " | " | " | " | " | Invention |
| 18 | " | " | " | " | " | " | " | Invention |
| 19 | " | " | " | " | " | " | " | Invention |
| 20 | " | " | " | " | " | " | " | Invention |
| 21 | " | " | " | " | " | " | " | Invention |
| 22 | " | " | " | " | " | " | " | Comparison |
| 23 | " | " | " | " | " | " | " | Comparison |
| 24 | 80/20 | " | 104 | 90 | 90 | 90 | 70 | Invention |
| 25 | 30/70 | " | 94 | 80 | 80 | 80 | 60 | Invention |

TABLE 6-continued

| Sample | Support; Compositional Ratio of Blend (PEN/PET) (wt/wt %) | Thickness (μm) | Tg (°C.) | Heat Treatment: First Gradual Cooling; at Constant Temperature: Retention Temperature (°C.) | Retention Time (hr.) | Second Gradual Cooling; −1° C./hr.: Initial Temperature (°C.) | Final Temperature (°C.) | Remarks |
|---|---|---|---|---|---|---|---|---|
| 26 | 25/75 | " | 83 | 70 | 70 | 70 | 50 | Comparison |
| 27 | 100/0 | 90 | 119 | 110 | 24 | 110 | 90 | Comparison |
| 28 | " | " | " | 60 | 60 | 60 | 50 | Comparison |
| 29 | PAr | 90 | 192 | 180 | 180 | 180 | 160 | Invention |
| 30 | PCT | " | 93 | 85 | 85 | 85 | 65 | Invention |

2) Surface treatment of support

Thereafter, support Samples 1 and 2, 4 to 26 and 28 to 30 each was subjected to glow discharge treatment.

The glow discharge treatment was conducted under the same conditions as in Example 1.

For the purpose of comparison, support Sample 3 was prepared by forming PEN into a film under the same conditions, of which both surfaces were not subjected to glow discharge treatment.

3) Coating of antistatic layer

On one surface of each of support Samples 1 to 26 and 27 to 30, a back formulation having the following composition was provided.

3-1) Preparation of dispersion solution of electrically conductive fine particles (dispersion solution of tin oxide-antimony oxide composite)

The preparation was conducted in the same manner as in Example 1.

3-2) Coating of back first layer (antistatic layer)

3-2-1) Coating of organic composition

A coating composition having the following formulation was coated in an amount as shown in Table 7 and dried at 115° C. for 30 seconds (at this time, the inner temperature of casing in the transportation system and the substantial temperature of conveying roller each was confirmed to be 115° C.) to produce Samples 1 to 9, 24 to 26 and 28 to 30.

| | |
|---|---|
| Electrically conductive fine particle dispersion ($SnO_2Sb_2O_3$, 0.05 μm) | as shown in Table 7 |
| Gelatin | as shown in Table 7 |
| Water | 27 parts by weight |
| Methanol | 60 parts by weight |
| Resorcine | 2 parts by weight |
| Poly(polymerization degree: 10)-oxyethylenenonylphenyl ether | as shown in Table 7 |

For the purpose of comparison, Sample 9 containing no dispersion of electrically conductive fine particles was prepared.

TABLE 7

| Sample | Formulated Amount of Electrically Conductive Dispersion (part by weight) | Amount of Coating Solution for Electrically Conductive Layer (ml/m²) | Formulated Amount (part by weight): Gelatin | Methyl cellulose | JU1 | GU1 | Compound JU-: 2 | 3 | 4 | 5 | 6 | GU2 | Remarks |
|---|---|---|---|---|---|---|---|---|---|---|---|---|---|
| 1 | 10 | 5 | 1 | 0 | 0.01 | 0 | 0 | 0 | 0 | 0 | 0 | 0 | Invention |
| 2 | 5 | 10 | 1 | 0 | 0.01 | 0 | 0 | 0 | 0 | 0 | 0 | 0 | Invention |
| 3 | 10 | 5 | 1 | 0 | 0.01 | 0 | 0 | 0 | 0 | 0 | 0 | 0 | Comparison |
| 4 | 10 | 5 | 1 | 0 | 0.01 | 0 | 0 | 0 | 0 | 0 | 0 | 0 | Invention |
| 5 | 10 | 5 | 1 | 0 | 0.01 | 0 | 0 | 0 | 0 | 0 | 0 | 0 | Invention |
| 6 | 10 | 5 | 1 | 0 | 0.01 | 0 | 0 | 0 | 0 | 0 | 0 | 0 | Invention |
| 7 | 20 | 2 | 1 | 0 | 0.01 | 0 | 0 | 0 | 0 | 0 | 0 | 0 | Invention |
| 8 | 40 | 1 | 1 | 0 | 0.01 | 0 | 0 | 0 | 0 | 0 | 0 | 0 | Invention |
| 9 | 0 | 5 | 1 | 0 | 0.01 | 0 | 0 | 0 | 0 | 0 | 0 | 0 | Comparison |
| 10 | 28 | 12 | 10 | 0.2 | 0 | 0 | 0 | 0 | 0 | 0 | 0 | 0 | Invention |
| 11 | 42 | 8 | 10 | 0.2 | 0 | 0 | 0 | 0 | 0 | 0 | 0 | 0 | Invention |
| 12 | 168 | 2 | 10 | 0.2 | 0 | 0 | 0 | 0 | 0 | 0 | 0 | 0 | Invention |
| 13 | 336 | 1 | 10 | 0.2 | 0 | 0 | 0 | 0 | 0 | 0 | 0 | 0 | Invention |
| 14 | 46 | 12 | 0 | 0 | 1 | 1 | 10 | 0 | 0 | 0 | 0 | 16 | Invention |
| 15 | 70 | 8 | 0 | 0 | 1 | 1 | 10 | 0 | 0 | 0 | 0 | 16 | Invention |
| 16 | 70 | 8 | 0 | 0 | 1 | 1 | 0 | 10 | 0 | 0 | 0 | 16 | Invention |
| 17 | 70 | 8 | 0 | 0 | 1 | 1 | 0 | 0 | 10 | 0 | 0 | 16 | Invention |
| 18 | 70 | 8 | 0 | 0 | 1 | 1 | 0 | 0 | 0 | 10 | 0 | 16 | Invention |
| 19 | 70 | 8 | 0 | 0 | 1 | 1 | 0 | 0 | 0 | 0 | 10 | 16 | Invention |
| 20 | 139 | 4 | 0 | 0 | 1 | 1 | 10 | 0 | 0 | 0 | 0 | 16 | Invention |
| 21 | 556 | 1 | 0 | 0 | 1 | 1 | 10 | 0 | 0 | 0 | 0 | 16 | Invention |
| 22 | 0 | 8 | 10 | 0.2 | 0 | 0 | 0 | 0 | 0 | 0 | 0 | 0 | Comparison |

TABLE 7-continued

| Sample | Formulated Amount of Electrically Conductive Dispersion (part by weight) | Amount of Coating Solution for Electrically Conductive Layer ($ml/m^2$) | Formulated Amount (part by weight) | | | | | | | | | | Remarks |
|---|---|---|---|---|---|---|---|---|---|---|---|---|---|
| | | | Gelatin | Methyl cellulose | JU1 | GU1 | Compound JU- 2 | 3 | 4 | 5 | 6 | GU2 | |
| 23 | 0 | 4 | 0 | 0 | 1 | 1 | 10 | 0 | 0 | 0 | 0 | 16 | Comparison |
| 24 | 10 | 5 | 1 | 0 | 0.01 | 0 | 0 | 0 | 0 | 0 | 0 | 0 | Invention |
| 25 | " | " | " | " | " | " | " | " | " | " | " | " | Invention |
| 26 | " | " | " | " | " | " | " | " | " | " | " | " | Comparison |
| 27 | " | " | " | " | " | " | " | " | " | " | " | " | Comparison |
| 28 | " | " | " | " | " | " | " | " | " | " | " | " | Comparison |
| 29 | " | " | " | " | " | " | " | " | " | " | " | " | Invention |
| 30 | " | " | " | " | " | " | " | " | " | " | " | " | Invention |

3-2-2) Coating of aqueous composition

The following formulation was coated on each support in an amount shown in Table 7 and dried at 115° C. for 30 seconds (at this time the temperature in the transportation system was the same as in 2-2-1) above) to prepare Samples 10 to 23. In the following, the part by weight shows the solid content weight.

| | |
|---|---|
| Electrically conductive fine particle dispersion ($SnO_2/Sb_2O_3$, 0.10 μm) | as shown in Table 7 |
| Gelatin | as shown in Table 7 |
| Water | 950 parts by weight |
| Methyl cellulose | as shown in Table 7 |
| Resorcine | 2 parts by weight |
| Compound JU1: Poly(polymerization degree: 10)-oxyethyl-enenonylphenyl ether | as shown in Table 7 |
| Compound GU1: p-Dodecanesulfophenylsulfophenyl ether · sodium salt | as shown in Table 7 |
| Compound JU2: Polyacrylic (methyl acrylate/ethyl acrylate/methyl methacrylate/dimethylaminoethyl methacrylate) copolymer (35:30:30:5 by mole) | as shown in Table 7 |
| Compound JU3: Polyacrylic (methyl acrylate/ethyl acrylate/methyl methacrylate/dimethylaminoethyl methacrylate) copolymer (27:35:25:2 by mole) | as shown in Table 7 |
| Compound JU4: Polyacrylic (methyl acrylate/ethyl acrylate/methyl methacrylate/dimethylaminoethyl methacrylate) copolymer (40:25:30:5 by mole) | as shown in Table 7 |
| Compound JU5: Polyacrylic (methyl acrylate/ethyl acrylate/methyl methacrylate/dimethylaminoethyl methacrylate) copolymer (Julymer ET410, produced by Nippon Kayaku K.K.) | as shown in Table 7 |
| Compound JU6: Polyacrylic (methyl acrylate/ethyl acrylate/methyl methacrylate/dimethylaminoethyl methacrylate) copolymer (35:30:30:5 by mole) | as shown in Table 7 |
| Compound GU2: Sorbitol · polyglycidyl ether | as shown in Table 7 |

For the purpose of comparison, Samples 22 and 23 each containing no dispersion of electrically conductive fine particles were prepared.

4) Evaluation on blocking resistance of samples applied by coating as above after glow discharge treatment Samples subjected to glow discharge treatment and applied by the above-described coating each was wound into a roll form under a tension of 200 g per 1 cm in width and then allowed to stand whole day at a temperature of Tg shown in Table 7 to evaluate the blocking resistance. Samples in a good condition free of blocking was ranked as A and samples involved in blocking was ranked as B. The rank A lies on the level sufficiently acceptable in practical use as the photographic material.

On the evaluation, all samples were free of blocking and ranked as A.

For the purpose of comparison, the case where in Sample 1, an antistatic layer was not provided was evaluated in the same manner and ranked as B. Accordingly, it is confirmed to be advantageous to provide the antistatic layer after glow discharge treatment and prior to the heat treatment of the support in view of improvement in blocking resistance.

5) Heat treatment of support

The supports prepared as above each was subjected to heat treatment under the conditions shown in Table 6. The heat treatment was conducted on each sample with the core of 30 cm in diameter while facing the undercoated surface outward in all cases. For the purpose of comparison in respect to the effects of the present invention, a support Sample 1 was prepared which was not subjected to heat treatment.

Also for the purpose of comparison between a method where an antistatic layer was provided and then heat treatment was conducted as seen in Samples 2 to 26 and 28 to 30 and a method where heat treatment was conducted and then an antistatic layer was provided, Sample 27 was prepared which was heat treated and then coated by an antistatic layer according to the method described in 3) above under the conditions shown in Table 7.

6) Coating of undercoat layer (on emulsion layer side)

An undercoating solution having the same composition as that for the undercoat layer in Example 2 was coated on each of support Samples 1 to 30 on the side opposite to that where an undercoat layer was provided, in an amount of 10 $ml/m^2$ by a wire bar and dried at 115° C. for 2 minutes and then the support was wound up.

The light-sensitive layers which will be described later were provided on this undercoated surface.

7) Coating of layers on antistatic layer (other back layers)

7-1) Coating of back second layer

A back dispersion coating solution was prepared to have the following formulation using diacetyl cellulose as a binder.

| | |
|---|---|
| Silicon dioxide (average particle size: | 0.01 part by weight |

-continued

| | |
|---|---|
| 0.3 μm) | |
| Aluminum oxide | 0.03 part by weight |
| Diacetyl cellulose | 1.0 part by weight |
| Methyl ethyl ketone | 9.4 parts by weight |
| Cyclohexanone | 9.4 parts by weight |
| Poly(polymerization degree: 10)oxyethyl-eneparanonylphenol ether | 0.06 part by weight |
| Trimethylolpropane-3-toluene diisocyanate adduct | 0.03 part by weight |
| Colloidal silica (Aerosil, average particle size: 0.02 μm) | 0.02 part by weight |
| $C_8F_{17}SO_2N(CH_3)(CH_2CH_2O)_6H$ | 0.01 part by weight |
| Poly(vinylidene difluoride/vinylidene tetrafluoride) (9:1 by mole) | 0.01 part by weight |
| Poly(methyl methacrylate/divinyl-benzene) (9:1 by mole, average particle size: 1.0 μm) | 0.01 part by weight |

The dispersion was conducted using a sand grinder at a rotation number of 2,000 for 2 hours. The dispersion media used were glass beads.

A toluene diisocyanate compound was added to the resulting solution in an amount of 30% based on the binder and the mixed solution was coated on the electrically conductive layer which was coated previously to give a coating amount of diacetyl cellulose as a solid content of 0.3 g/m$^2$, and dried at 115° C. for 3 minutes (at this time, the inner temperature of casing in the transportation system and the substantial temperature of conveying roller each was confirmed to be 115° C.).

7-2) Coating of back third layer (slide layer)

Preparation of dispersion of sliding agent

The following two sliding agents were mixed at a ratio of 4:1, an equivalent weight of xylene was added thereto and dissolved under heating at 100° C. and to the resulting solution, room temperature isopropanol was added without a break in an amount of 10 times the sliding agent solution while stirring and applying ultrasonic waves to prepare a dispersion. The resulting dispersion was diluted with xylene/cyclohexanone/isopropanol (70/25/5 by weight) and finely dispersed in a high-pressure homogenizer (25° C., 300 kg/cm$^2$) to have a sliding agent concentration of 0.1 wt %. The resulting dispersion was coated by a slide coating method to have a coverage of 15 mg/m$^2$ and dried at 115° C. for 5 minutes (at this time, the inner temperature of casing in the transportation system and the substantial temperature of conveying roller each was confirmed to be 115° C.).

| | |
|---|---|
| $n—C_{17}H_{35}COOC_{30}H_{61}—n$ | 4 parts by weight |
| $n—C_{30}H_{61}O(CH_2CH_2O)_{10}H$ | 1 part by weight |

8) Preparation of photographic material 8-1) Preparation of multilayered color photographic material A multilayered color photographic material as a sample was prepared by coating layers each having the same composition as in Example 1 on each support sample provided with an undercoat layer on the side opposite to that provided by a back layer.

9) Evaluation of photographic film

The curling habit of each of 30 photographic samples was evaluated according to the following procedure.

9-1) Core set

The sample film was cut into a slit of 35 mm in width and 1.2 m in length. After leaving the film to stand at 25° C. and 60% RH for one night to adjust the moisture, the film was wound round a spool of 7 mm while facing the light-sensitive layers inwardly. The film was placed in a closed container and heated at 80° C. for 2 hours to have a curling habit. This was the condition set by imaging a film left in an automobile in summer season.

9-2) Evaluation on unevenness in development, film folding (folding at film end edge) and curling after development The film having a curling habit imposed under the above-described condition was released to cool in a room at 25° C., then the sample film was taken out from the closed container and each photographic material was developed under the following conditions.

9-2-1) Conditions for development of multilayered color photographic material

The automatic processor used was Mini-Lab FP-560B manufactured by Fuji Photo Film Co., Ltd. The development conditions are shown below. The samples used for determination were processed with a processing solution used in a separate running processing of a film which had been previously imagewise exposed, conducted until the replenishing amount of the color developer reached 3 times the tank volume. The processing formulation was CN-16FA.

After processing, each photographic material was subjected to determination using a curl plate under conditions of 25° C. and 60% RH.

Further, evaluation was also made on unevenness in development and folding at the film end edge, each being ascribable to the strong curling. The unevenness in development was indicated by the area (%) processed unevenly and only those with no unevenness in development, namely 0%, are acceptable as the photographic material. With respect to the folding at the film end edge, when end edge folding was not generated, the evaluation is A, and when a transportation trouble was caused, the evaluation is B. Only those with no occurrence of end edge folding and evaluated as A are allowable as the photographic material.

9-3) Evaluation on adhesion in dry condition

Six slits were made on the emulsion side surface and the back side surface by a razor at a distance of 5 mm in length and breadth to form 25 squares and a pressure sensitive adhesive tape (Nitto-Tape, produced by Nitto Denki Kogyo K.K.) was affixed thereto and promptly peeled off at an angle of 180°. The adhesion was evaluated by the peeled area (%) on the surface of photographic material. Those having a peeled area of less than 5% are sufficiently durable in practical use as the photographic material.

9-4) Evaluation on adhesion in wet condition

A mark x was scratched by a pencil on the emulsion surface and back surface of film in a solution during each processing step of color development, fixing or stabilization and the film was strongly rubbed five times by a finger tip capped with a rubber sack, and the adhesive force was evaluated by the maximum breadth peeled along the mark x.

Those having a peeled breadth of 0 m, that is, no peeling except for the scratched mark are said to have an adhesion strength sufficiently durable in practical use as the photographic material.

9-5) Static mark test

After unexposed samples each was subjected to moisture conditioning at 25° C. and 10% RH for 6 hours, each sample was rubbed with rubber roller and urethane roller to examine how the static marks grew on respective materials, then processed with the above-described developer, fixed and washed with water. Evaluation was made by the occurrence number of static marks.

Those having no static mark (0 per m$^2$ of the photographic material) are sufficiently durable in practical use as the photographic material.

9-6) Dust attachment test:

Evaluation was made in the same method as in Example 2.

Those having no attachment of dusts are sufficiently durable in practical use as the photographic material.

10) Results

TABLE 8

| | | | | Multilayered Color Photographic Material | | | | |
|---|---|---|---|---|---|---|---|---|
| | | | | Adhesion | Adhesion | Developed Film | | |
| Sample | Uneven Coating or Poor Drying of Antistatic Layer | Static Mark Test (%) | Dust Attachment Test | in Dry Condition (%) | in Wet Condition (mm) | Unevenness in Development (%) | End Edge Folding | Remarks |
| 1 | A | 0 | A | 0 | 0 | 38 | B | Invention |
| 2 | B | 20 | C | 0 | 0 | 0 | A | Invention |
| 3 | A | 0 | A | 96 | 10 | 0 | A | Comparison |
| 4 | A | 0 | A | 0 | 0 | 0 | A | Invention |
| 5 | A | 0 | A | 0 | 0 | 0 | A | Invention |
| 6 | A | 0 | A | 0 | 0 | 0 | A | Invention |
| 7 | A | 0 | A | 0 | 0 | 0 | A | Invention |
| 8 | B | 15 | C | 0 | 0 | 0 | A | Invention |
| 9 | A | 30 | C | 0 | 0 | 0 | A | Comparison |
| 10 | B | 15 | C | 0 | 0 | 0 | A | Invention |
| 11 | A | 0 | A | 0 | 0 | 0 | A | Invention |
| 12 | A | 0 | A | 0 | 0 | 0 | A | Invention |
| 13 | B | 20 | C | 0 | 0 | 0 | A | Invention |
| 14 | B | 20 | C | 0 | 0 | 0 | A | Invention |
| 15 | A | 0 | A | 0 | 0 | 0 | A | Invention |
| 16 | A | 0 | A | 0 | 0 | 0 | A | Invention |
| 17 | A | 0 | A | 0 | 0 | 0 | A | Invention |
| 18 | A | 0 | A | 0 | 0 | 0 | A | Invention |
| 19 | A | 0 | A | 0 | 0 | 0 | A | Invention |
| 20 | A | 0 | A | 0 | 0 | 0 | A | Invention |
| 21 | B | 20 | C | 0 | 0 | 0 | A | Invention |
| 22 | A | 30 | C | 0 | 0 | 0 | A | Comparison |
| 23 | A | 30 | C | 0 | 0 | 0 | A | Comparison |
| 24 | A | 0 | A | 0 | 0 | 0 | A | Invention |
| 25 | A | 0 | A | 0 | 0 | 0 | A | Invention |
| 26 | A | 0 | A | 0 | 0 | 40 | B | Comparison |
| 27 | A | 5 | B | 80 | 8 | 42 | A | Comparison |
| 28 | A | 0 | A | 0 | 0 | 43 | B | Comparison |
| 29 | A | 0 | A | 0 | 0 | 0 | A | Invention |
| 30 | A | 0 | A | 0 | 0 | 0 | A | Invention |

The results obtained are shown in Table 8.

Samples comprising an electrically conductive layer according to the present invention showed, as seen in the static mark test, good static resistance after development, whereas Samples 9, 22 and 23 using no metal oxide of the present invention had a volume resistivity of 1×10 Ωcm or more to reveal to be poor in the electric charge preventing ability at a low humidity (25° C., 10% RH). From this, it is seen that by using a metal oxide having a volume resistivity of $1\times10^7$ Ωcm or less, superior electric charge preventing ability is provided. Further, in Samples 8, 10, 13, 14 and 21, in which the concentration or coating amount of the electrically conductive material was outside the range of the present invention, uneven coating or bad coating was caused and not only the antistatic property but also the photographic property were adversely affected to an extreme extent. The results of dust attachment test shown in Table 8 are those for the multilayered color photographic material after development.

From this, it is seen that by providing an electrically conductive layer using an electrically conductive material at a concentration or in a coating amount within the scope of the present invention, an excellent antistatic property was exhibited before and after development.

Sample 27, in which processings were conducted in a different order from that of the present invention, namely, after glow discharge treatment, heat treatment was first conducted and then an antistatic layer was coated, underwent blocking of the support.

As seen from the foregoing, by providing at least one electrically conductive layer directly on the support after surface treatment and prior to heat treatment at a temperature of from 50° C. to the Tg of the polyester support, a silver halide photographic material exhibiting excellent adhesion preventing performance after heat treatment can be obtained.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide photographic material comprising a polyester support having thereon at least one light-sensitive layer and at least one undercoat layer, wherein said undercoat layer is provided directly on said support by coating a solution containing gelatin for an undercoating binder having a calcium ion ($Ca^{++}$) content of from 10 to 2,500 ppm based on dry gelatin.

2. The process for producing a silver halide photographic material as claimed in claim 1, wherein said undercoat layer contains a polyamide-epihalohydrin resin.

3. The process for producing a silver halide photographic material as claimed in claim 1, wherein said polyester support is subjected to surface treatment.

4. The process for producing a silver halide photographic material as claimed in claim 3, wherein said surface treatment is ultraviolet light irradiation treatment.

5. The process for producing a silver halide photographic material as claimed in claim 3, wherein said surface treatment is glow discharge treatment.

6. The process for producing a silver halide photographic material as claimed in claim 1, wherein said electrically conductive layer contains at least one electrically conductive material selected from metal oxides mainly comprising Zn, Ti, Sn, Al, In, Si, Mg, Ba, Mo, W or V and having a volume resistivity of $10^7$ Ωcm or less.

7. The process for producing a silver halide photographic material as claimed in claim 1, wherein said polyester support has a glass transition temperature (Tg) of from 90° to 200° C.

8. The process for producing a silver halide photographic material as claimed in claim 1, wherein said polyester support comprises polyester containing 30 mol % or more of naphthalenedicarboxylic acid based on the entire dicarboxylic acid.

9. The process for producing a silver halide photographic material as claimed in claim 1, wherein said polyester support is polyethylene-2,6-naphthalenedicarboxylate.

10. The process for producing a silver halide photographic material as claimed in claim 1, wherein said undercoat layer contains a nonionic surface active agent.

11. The process for producing a silver halide photographic material as claimed in claim 6, wherein said electrically conductive layer is provided by coating an organic composition having dispersed therein an electrically conductive material and containing therein a hydrophobic solvent in an amount of from 50 wt % to less than 100 wt %.

12. The process for producing a silver halide photographic material as claimed in claim 6, wherein said electrically conductive layer is provided by coating an aqueous composition having dispersed therein an electrically conductive layer and containing therein water in an amount of from 50 wt % to less than 100 wt %.

13. The process for producing a silver halide photographic material as claimed in claim 6, wherein said electrically conductive layer is provided by coating a composition having an electrically conductive material concentration of from 1 to 20 wt % in an amount of from 10 to 20 ml/$m^2$.

14. The process for producing a silver halide photographic material as claimed in claim 1, wherein said polyester support is subjected to pre-heat treatment at a temperature of from Tg to less than a melting point of the polyester support and then to post-heat treatment at a temperature of from 50° C. to less than the Tg of the support.

15. The process for producing a silver halide photographic material as claimed in claim 1, wherein said gelatin for the undercoating binder is swelled first with water and then with an organic solvent containing an acid and dissolved under heating to provide the undercoating solution for the undercoat layer.

16. The process for producing a silver halide photographic material as claimed in claim 15, wherein said acid has a pKa (a negative logarithm of an acid dissociation factor) in water of from −8.0 to 4.0.

17. The process for producing a silver halide photographic material as claimed in claim 15, wherein said acid is at least one selected from the group consisting of salicylic acid, boric acid, hydrochloric acid, sulfuric acid and phosphoric acid.

18. The process for producing a silver halide photographic material as claimed in claim 1, wherein the gelatin for the undercoating binder has a calcium ion ($Ca^{++}$) content of from 20 to 500 ppm based on dry gelatin.

19. The process for producing a silver halide photographic material as claimed in claim 2, wherein the polyamide-epihalohydrin resin is contained in an amount of from 0.5 to 25 wt % based on the dry weight of gelatin.

20. The process for producing a silver halide photographic material as claimed in claim 19, wherein the polyamide-epihalohydrin resin has a molecular weight of from $5\times10^3$ to $1\times10^5$.

* * * * *